US005821962A

United States Patent [19]

Kudo et al.

[11] Patent Number: 5,821,962

[45] Date of Patent: Oct. 13, 1998

[54] LIQUID EJECTION APPARATUS AND METHOD

[75] Inventors: Kiyomitsu Kudo, Yokohama; Makiko Kimura, Sagamihara; Toshio Kashino, Chigasaki; Takeshi Okazaki, Sagamihara; Aya Yoshihira, Yokohama; Yoshie Nakata, Matsumoto, all of Japan

[73] Assignee: Canon Kabushiki Kaisha, Tokyo, Japan

[21] Appl. No.: 652,682

[22] Filed: May 30, 1996

[30] Foreign Application Priority Data

Jun. 2, 1995 [JP] Japan ..... 7-136863

[51] Int. Cl.[6] ..... B41J 2/05

[52] U.S. Cl. ..... 347/65

[58] Field of Search ..... 347/65, 63, 94

[56] References Cited

U.S. PATENT DOCUMENTS

| | | | |
|---|---|---|---|
| 4,480,259 | 10/1984 | Kruger et al. | 347/63 |
| 4,496,960 | 1/1985 | Fischbeck | 347/68 |
| 4,723,129 | 2/1988 | Endo et al. | 347/56 |
| 5,278,585 | 1/1994 | Karz et al. | 347/65 |
| 5,485,186 | 1/1996 | Ishinaga et al. | 347/65 |

FOREIGN PATENT DOCUMENTS

| | | | |
|---|---|---|---|
| 40922/96 | 8/1996 | Australia | B41J 2/045 |
| 40923/96 | 8/1996 | Australia | B41J 2/045 |
| 40925/96 | 8/1996 | Australia | B41J 2/045 |
| 50663/96 | 10/1996 | Australia | B41J 2/045 |
| 50665/96 | 10/1996 | Australia | B41J 2/055 |
| 50669/96 | 10/1996 | Australia | B41J 2/055 |
| 50894/96 | 11/1996 | Australia | B41J 2/055 |
| 50895/96 | 11/1996 | Australia | B41J 2/055 |
| 50896/96 | 11/1996 | Australia | B41J 2/055 |
| 0 436 047 | 7/1991 | European Pat. Off. | B41J 2/055 |
| 0 443 798 | 8/1991 | European Pat. Off. | B41J 2/14 |
| 0 504 879 | 9/1992 | European Pat. Off. | B41J 2/05 |
| 0 739 734 | 10/1996 | European Pat. Off. | B41J 2/045 |
| 55-081172 | 6/1980 | Japan | B41J 3/04 |
| 61-069467 | 4/1986 | Japan | B41J 3/04 |
| 61-110557 | 5/1986 | Japan | B41J 3/04 |
| 62-156969 | 7/1987 | Japan | B41J 3/04 |
| 62-196154 | 8/1987 | Japan | B41J 3/04 |
| 63-197652 | 8/1988 | Japan | B41J 3/04 |
| 63-199972 | 8/1988 | Japan | F16K 15/14 |
| 3-081155 | 4/1991 | Japan | B41J 2/05 |
| 5-124189 | 5/1993 | Japan | B41J 2/05 |
| 6-087214 | 3/1994 | Japan | B41J 2/05 |

*Primary Examiner*—Joseph W. Hartary
*Attorney, Agent, or Firm*—Fitzpatrick, Cella, Harper & Scinto

[57] ABSTRACT

A liquid ejecting head for ejecting liquid by generation of a bubble includes an ejection outlet through which the liquid is ejected; a liquid flow path in fluid communication with the ejection outlet; a bubble generation region for generate the bubble in the liquid; a movable member disposed opposed to the bubble generation region and provided with a base portion and a free end portion closer to the ejection outlet than the base portion; wherein the movable member is displaced by a pressure produced by the bubble generated in the bubble generation region to eject the liquid through the ejection outlet; wherein the movable member has an inflection portion at a portion opposed to the bubble generation region.

54 Claims, 20 Drawing Sheets

FIG. 12(a)
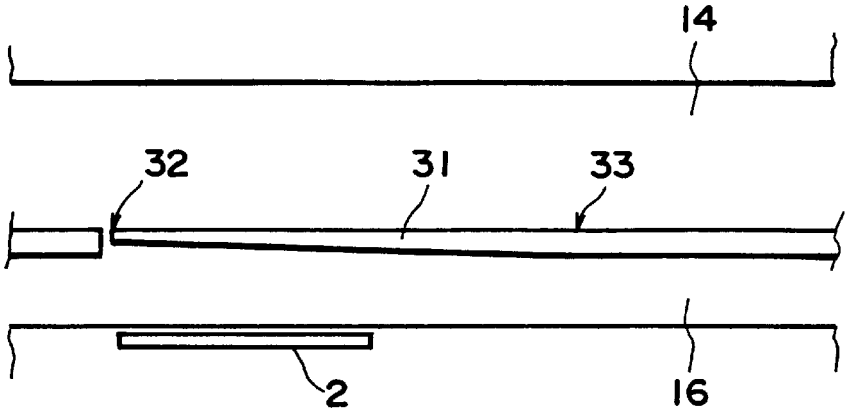
FIG. 12(b)
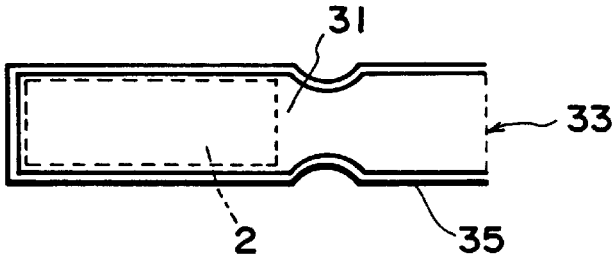
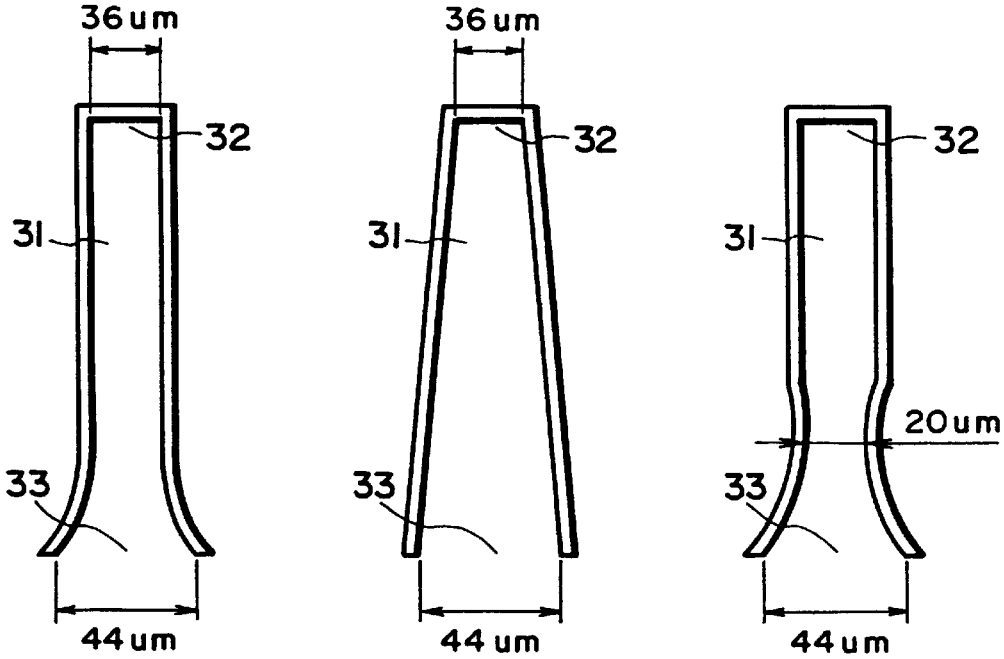
FIG. 13(a) FIG. 13(b) FIG. 13(c)

FIG. 15(a)
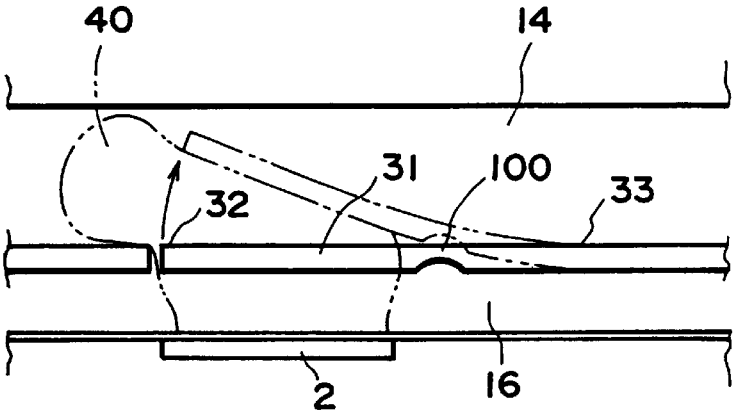
FIG. 15(b)
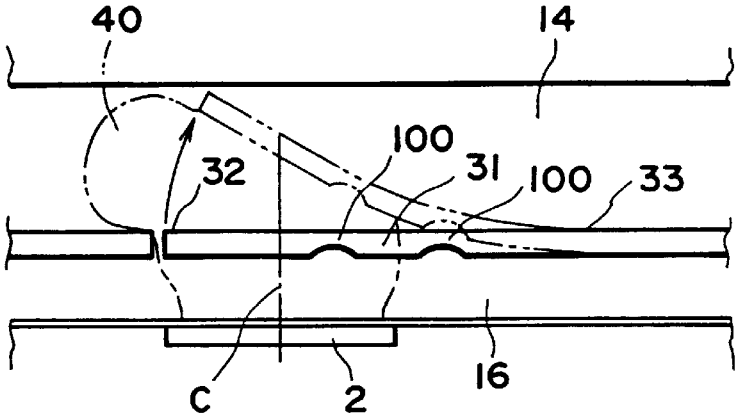
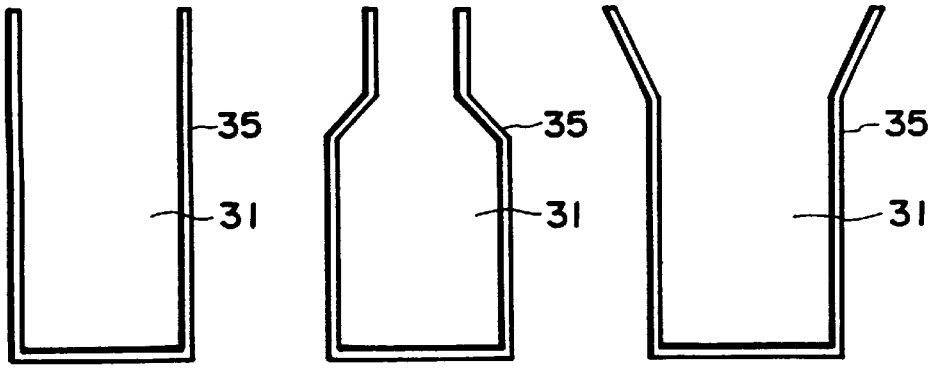
FIG. 16(a) FIG. 16(b) FIG. 16(c)

LIQUID EJECTION APPARATUS AND METHOD

FIELD OF THE INVENTION AND RELATED ART

The present invention relates to a liquid ejecting head for ejecting desired liquid using generation of a bubble by applying thermal energy to the liquid, a head cartridge using the liquid ejecting head, a liquid ejecting device using the same, and a liquid ejecting method. It further relates to an ink jet head kit containing the liquid ejection head.

More particularly, it relates to a liquid ejecting head having a movable member movable by generation of a bubble, and a head cartridge using the liquid ejecting head, and liquid ejecting device using the same. It further relates to a liquid ejecting method and recording method for ejection the liquid by moving the movable member using the generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 propose flow passage structures as disclosed in FIG. 1, (*a*) and (*b*), for example.

The liquid path or passage structure of a manufacturing method therefor are proposed from the standpoint of the back wave toward the liquid chamber. This back wave is considered as energy loss since it does not contribute to the liquid ejection. It proposes a valve 10 disposed upstream of the heat generating element 2 with respect to the direction of general flow of the liquid, and is mounted on the ceiling of the passage. It takes an initial position wherein it extends along the ceiling. Upon bubble generation, it takes the position wherein it extends downwardly, thus suppressing a part of the back wave by the valve 10. When the valve is generated in the path 3, the suppression of the back wave is not practically significant. The back wave is not directly contributable to the ejection of the liquid. Upon the back wave occurs in the path, the pressure for directly ejecting the liquid already makes the liquid ejectable from the passage.

On the other hand, in the bubble jet recording method, the heating is repeated with the heat generating element contacted with the ink, and therefore, a burnt material is deposited on the surface of the heat generating element due to kogation of the ink. However, the amount of the deposition may be large depending on the materials of the ink. If this occurs, the ink ejection becomes unstable. Additionally, even when the liquid to be ejected is the one easily deteriorated by heat or even when the liquid is the one with which the bubble generation is not sufficient, the liquid is desired to be ejected in good order without property change.

Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to a quite high degree. In addition, the deformation of the flexible film is not so large, and therefore, the energy use efficiency and the ejection force are deteriorated although the some effect is provided by the provision between the ejection liquid and the bubble generation liquid.

The present invention is particularly directed to an improvement of the durability of a movable member.

The behavior of movable member at the portion opposed to the bubble generation region is investigated, and the durability of the movable member is improved while the ejection efficiency and the ejection power are further stabilized.

SUMMARY OF THE INVENTION

Accordingly, it is a principal object of the present invention to provide a liquid ejection head and method wherein a movable member is used to control a generated bubble, thus improving the ejection efficiency or the ejection speed of the liquid, and wherein a change point (inflection point) is provided in the displacement region of the movable member.

It is another object of the present invention to provide a liquid ejecting method, liquid ejecting head and so on wherein heat accumulation in the liquid on the heat generating element is significantly reduced, and the residual bubble on the heat generating element is reduced, while improving the ejection efficiency and the ejection pressure.

It is a further object of the present invention to provide a liquid ejecting head and so on wherein inertia force in a direction against liquid supply direction due to back wave is suppressed, and simultaneously, a degree of retraction of a meniscus is reduction by a valve function of a movable member by which the refilling frequency is increased, thus permitting high speed printing.

It is a further object of the present invention to provide a liquid ejecting head and so on wherein deposition of residual material on the heat generating element is reduced, and the range of the usable liquid is widened, and in addition, the ejection efficiency and the ejection force are significantly increased.

It is a further object of the present invention to provide a liquid ejection method and a liquid ejection head, wherein excessive vibration is regulated within a desired range, and the durability of the movable member is improved.

It is a further object of the present invention to provide a liquid ejecting method, liquid ejecting head or the like wherein the selection latitude for the ejecting liquid is increased.

It is a further object of the present invention to provide a head kit with which the liquid to be supplied to the liquid ejecting head is accomplished.

According to an aspect of the present invention, there is provided a liquid ejecting head for ejecting liquid by generation of a bubble, comprising: an ejection outlet through which the liquid is ejected; a liquid flow path in fluid communication with the ejection outlet; a bubble generation region for generate the bubble in the liquid; a movable member disposed opposed to the bubble generation region and provided with a base portion and a free end portion closer to the ejection outlet than the base portion; wherein the movable member is displaced by a pressure produced by the bubble generated in the bubble generation region to eject the liquid through the ejection outlet; wherein the movable member has an inflection portion at a portion opposed to the bubble generation region.

According to another aspect of the present invention, there is provided a liquid ejecting head for ejecting liquid by generation of a bubble, comprising: an ejection outlet through which the liquid is ejected; a liquid flow path in fluid communication with the ejection outlet; a bubble generation region for generate the bubble in the liquid; a movable member disposed opposed to the bubble generation region and provided with a base portion and a free end portion closer to the ejection outlet than the base portion; wherein the movable member is displaced by a pressure produced by the bubble generated in the bubble generation region to eject the liquid through the ejection outlet; wherein the movable member has a portion having a thickness smaller than that at the base portion.

According to a further aspect of the present invention, there is provided a liquid ejecting head for ejecting liquid by generation of a bubble, comprising: an ejection outlet; a first liquid flow path in fluid communication with the ejection outlet; a second liquid flow path having a bubble generation region for generating the bubble in the liquid by applying heat in the liquid; a movable member disposed between the first liquid flow path and the bubble generation region and a free end adjacent the ejection outlet, wherein the free end is displaced into the first liquid flow path by a pressure produced by generation of the bubble in the bubble generation region to direct the pressure toward the ejection outlet of the first liquid flow path; wherein the movable member has a portion having a thickness smaller than that at the base portion.

With the liquid ejecting method and the head using the novel ejection principle, a synergistic effect is provided by the generated bubble and the movable member moved thereby so that the liquid adjacent the ejection outlet can be ejection with high efficiency, and therefore, the ejection efficiency is improved. For example, in the most desirable type of the present invention, the ejection efficiency is increased even to twice the conventional one.

In another aspect of the present invention, even if the printing operation is started after the recording head is left in a low temperature or low humidity condition for a long term, the ejection failure can be avoided. Even if the ejection failure occurs, the normal operation is recovered by a small scale recovery process including a preliminary ejection and sucking recovery.

In this invention, "change point or portion" means a point or portion of inflection of the deformation property of the movable member, which point or portion may be provided by changing a thickness, material and/or width or the like.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

The free end portion or region of the movable member may mean the free end edge at the downstream side of the movable member or may mean the free end edge and the lateral edges adjacent the free end.

The resistance against the motion of the movable member means the resistance due to the liquid itself or the structure of the liquid passage when the movable member moves away from the bubble generation region by the generation of the bubble. The resistance may be reduced by providing a resistance inclination, using a resistance by physical stopper, using a resistance of virtual stopper with the use of fluid.

The resistance is called herein after resistance or flow resistance.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 12, (*a*), is a sectional schematic view illustrating another example of a movable member usable with the present invention, and (*b*) is a schematic plan view.

FIG. 13, (*a*), (*b*) and (*c*), are sectional schematic views illustrating another example of a movable member usable with the present invention.

FIG. 15, (*a*) and (*b*), are schematic view illustrating a configuration of a movable member having a change portion according to an embodiment of the present invention.

FIG. 16, (*a*), (*b*) and (*c*), are a top plan view illustrating a further example of a configuration of the movable member.

DESCRIPTION OF THE PREFERRED EMBODIMENTS

Figure 1A:
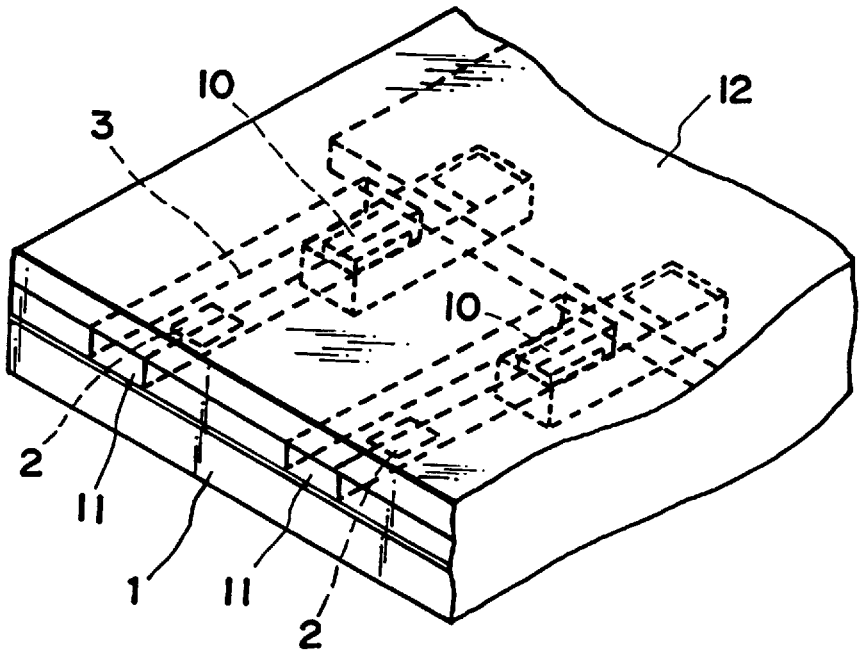
FIG. 1(a) PRIOR ART
FIG. 1, (*a*) and (*b*) are schematic views illustrating flow passage structure of two liquid ejecting heads of conventional types.
Figure 1B:
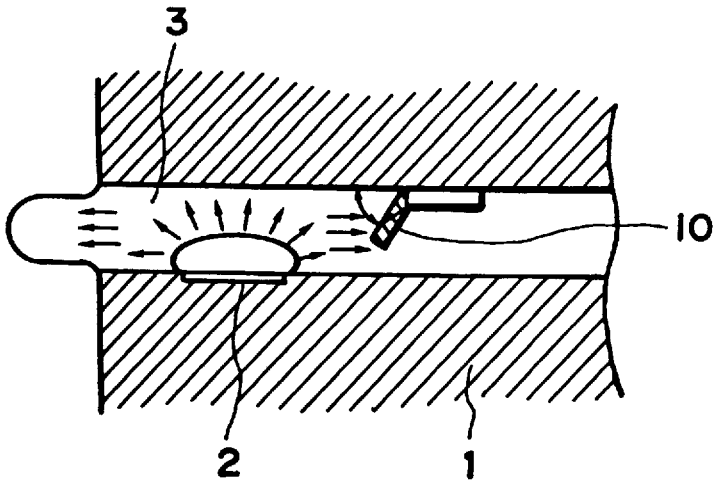
FIG. 1(b) PRIOR ART
Figure 2A:
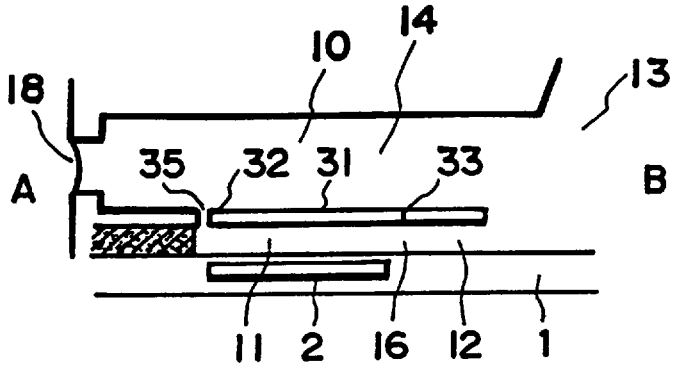
FIG. 2(a) PRIOR ART
FIG. 2, (*a*), (*b*), (*c*) and (*d*), are schematic sectional views illustrating the ejection principle in an example of a liquid ejecting head.
Figure 2B:
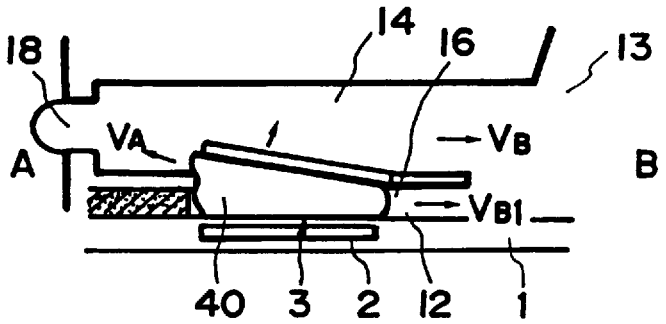
FIG. 2(b) PRIOR ART
Figure 2C:
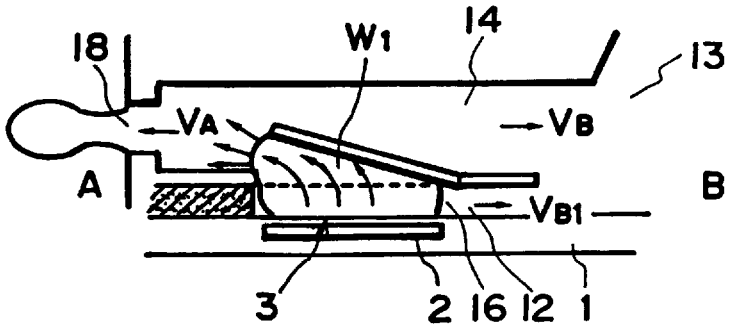
FIG. 2(c) PRIOR ART
Figure 2D:
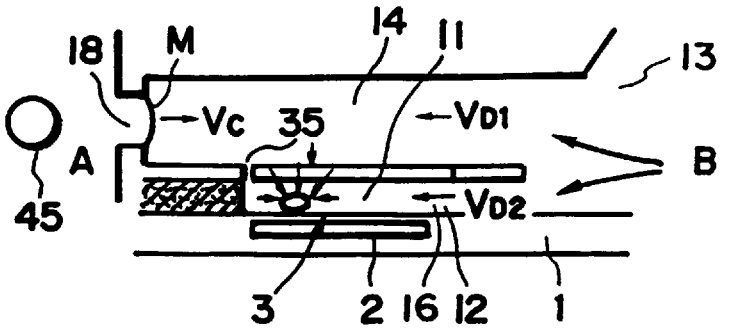
FIG. 2(d) PRIOR ART
Figure 3:
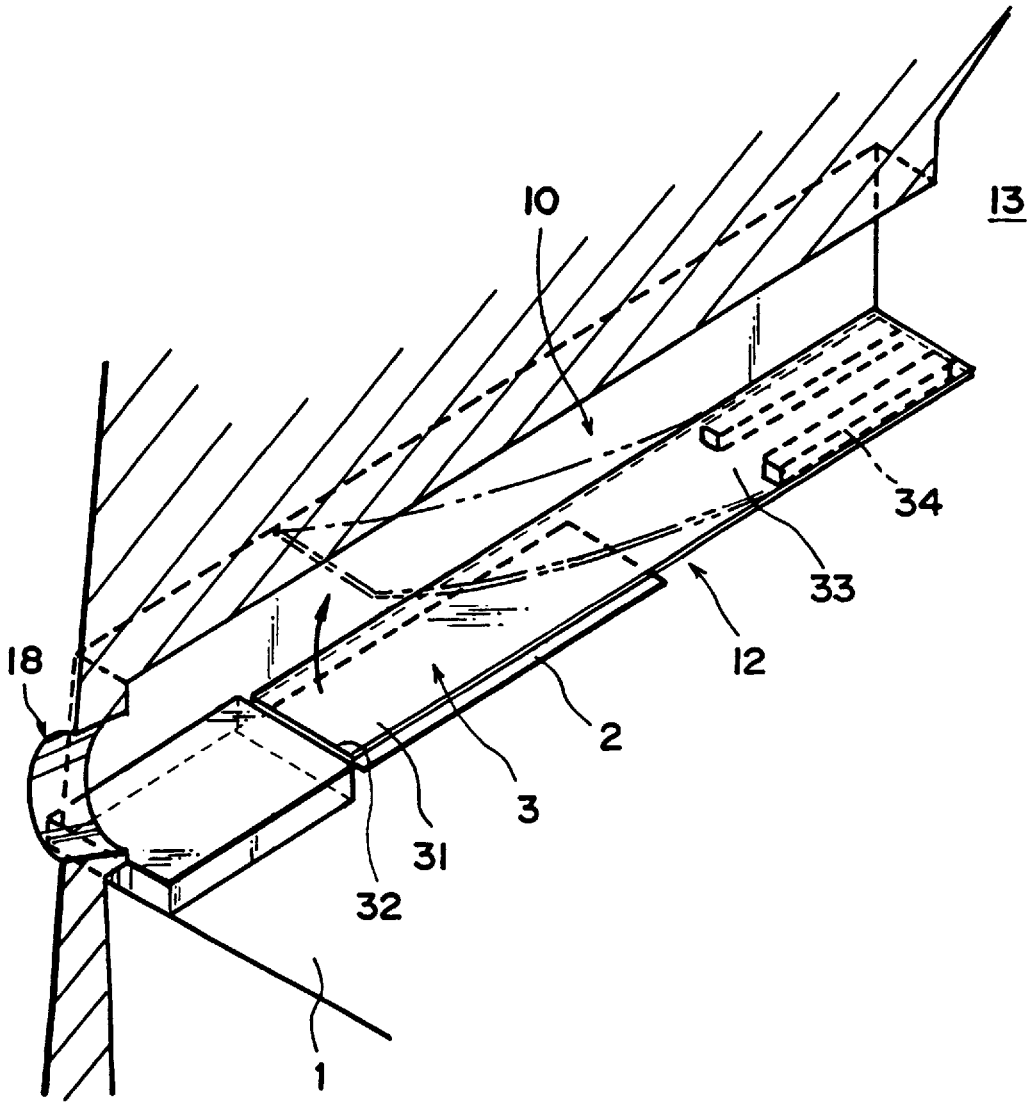
FIG. 3 PRIOR ART
FIG. 3 is a partly broken perspective view of the liquid ejecting head shown in FIG. 1.

FIG. 2 is a schematic sectional view of a liquid ejecting head taken along a liquid flow path usable with this embodiment, and FIG. 3 is a partly broken perspective view of the liquid ejecting head.

The liquid ejecting head of this embodiment comprises a heat generating element 2 (a heat generating resistor of 40 $\mu$m×105 $\mu$m in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18.

Above the element substrate in the liquid flow path 10, a movable member or plate 31 in the form of a cantilever of an elastic material such as metal is provided faced to the heat generating element 2. One end of the movable member is fixed to a foundation (supporting member) 34 or the like provided by patterning of photosensitivity resin material on the wall of the liquid flow path 10 or the element substrate. By this structure, the movable member is supported, and a fulcrum (fulcrum portion) is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and that it has a free end (free end portion) 32 in a downstream side of the fulcrum 33. The movable member 31 is faced to the heat generating element 2 with a gap of 15 $\mu$m approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that the movable member 31 moves or displaces to widely open toward the ejection outlet side about the fulcrum 33, as shown in FIG. 2, (*b*) and (*c*) or in FIG. 3. By the displacement of the movable member 31 or the state after the displacement, the propagation of the pressure caused by the generation of the bubble and the growth of the bubble per se are directed toward the ejection outlet.

Here, one of the fundamental ejection principles used with the present invention will be described. One of important principles of this invention is that the movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the ejection outlet 18 (downstream side).

Figure 4:
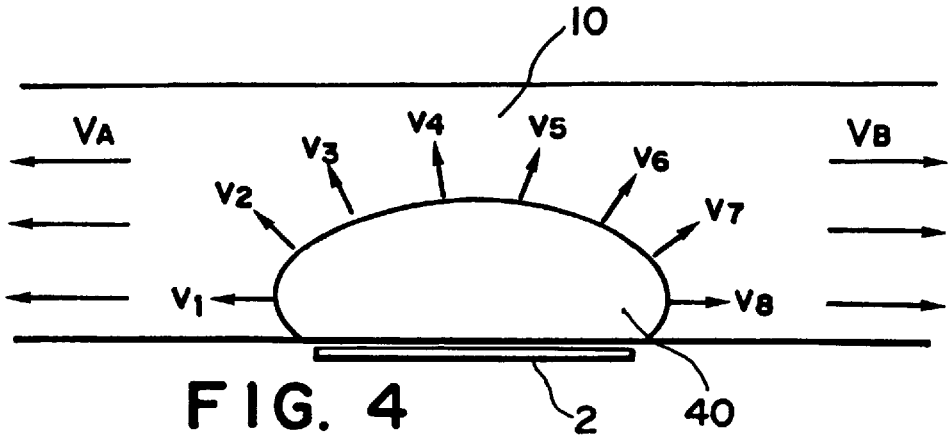
FIG. 4 PRIOR ART
FIG. 4 is a schematic sectional view illustrating pressure propagation from the bubble in a conventional liquid ejecting head.
Figure 5:
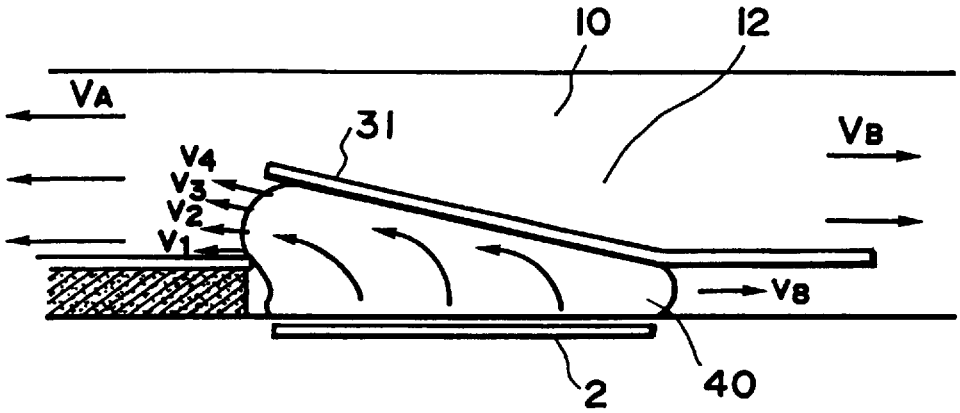
FIG. 5 is a schematic sectional view showing pressure propagation from the bubble in the ejection principle usable with the present invention.

More detailed description will be made with comparison between the conventional liquid flow passage structure not using the movable member (FIG. 4) and the present invention (FIG. 5). Here, the direction of propagation of the pressure toward the ejection outlet is indicated by $V_A$, and the direction of propagation of the pressure toward the upstream is indicated by $V_B$.

In a conventional head as shown in FIG. 4, there is not any structural element effective to regulate the direction of the propagation of the pressure produced by the bubble 40 generation. Therefore, the direction of the pressure propagation of the is normal to the surface of the bubble as indicated by V1–V8, and therefore, is widely directed in the passage. Among these directions, those of the pressure propagation from the half portion of the bubble closer to the ejection outlet (V1–V4) have the pressure components in the $V_A$ direction which is most effective for the liquid ejection. This portion is important since it directly contributable to the liquid ejection efficiency, the liquid ejection pressure and the ejection speed. Furthermore, the component V1 is closest to the direction of $V_A$ which is the ejection direction, and therefore, is most effective, and the V4 has a relatively small component in the direction $V_A$.

On the other hand, in the case of the present invention, shown in FIG. 5, the movable member 31 is effective to direct, to the downstream (ejection outlet side), the pressure propagation directions V1–V4 of the bubble which otherwise are toward various directions. Thus, the pressure propagations of bubble 40 are concentrated, so that the pressure of the bubble 40 is directly and efficiently contributable to the ejection.

The growth direction per se of the bubble is directed downstream similarly to the pressure propagation directions V1–V4, and grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIG. 2, the ejecting operation of the liquid ejecting head in this example will be described in detail.

FIG. 2, (*a*) shows a state before the energy such as electric energy is applied to the heat generating element 2, and therefore, no heat has yet been generated. It should be noted that the movable member 31 is so positioned as to be faced at least to the downstream portion of the bubble generated by the heat generation of the heat generating element. In other words, in order that the downstream portion of the bubble acts on the movable member, the liquid flow passage structure is such that the movable member 31 extends at least to the position downstream (downstream of a line passing through the center 3 of the area of the heat generating element and perpendicular to the length of the flow path) of the center 3 of the area of the heat generating element.

FIG. 2, (*b*) shows a state wherein the heat generation of heat generating element 2 occurs by the application of the electric energy to the heat generating element 2, and a part of the liquid filled in the bubble generation region 11 is heated by the thus generated heat so that a bubble is generated through the film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 2, (*c*) shows a state in which the bubble 40 has further grown. By the pressure resulting from the bubble 40 generation, the movable member 31 is displaced further. The generated bubble grows more downstream than upstream, and it expands greatly beyond a first position (broken line position) of the movable member.

As the movable member 31 gradually moves in response to the growth of the bubble 40 as described above, the bubble 40 is controlled so that it grows in the direction in which the pressure generated by the bubble 40 can easily escape or be released, and in which the bubble 40 easily shifts in volumetric terms. In other words, the growth of the bubble is uniformly directed toward the free end of the movable member. This also is thought to contribute to the improvement of the ejection efficiency.

Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 2, (*d*) shows a state wherein the bubble 40 contracts and disappears by the decrease of the pressure in the bubble, peculiar to the film boiling phenomenon.

The movable member 31 having been displaced to the second position returns to the initial position (first position) of FIG. 2, (*a*) by the restoring force provided by the spring property of the movable member per se and the negative pressure due to the contraction of the bubble. Upon the collapse of bubble, the liquid flows back from the common liquid chamber side as indicated by $V_{D1}$, and $V_{D2}$ and from the ejection outlet side as indicated by $V_c$ so as to compensate for the volume reduction of the bubble in the bubble generation region 11 and to compensate for the volume of the ejected liquid.

In the foregoing, the description has been made as to the operation of the movable member with the generation of the bubble and the ejecting operation of the liquid. Now, the description will be made as to the refilling of the liquid in the liquid ejecting head usable with the present invention.

Referring to FIG. 2, liquid supply mechanism will be described.

When the bubble 40 enters the bubble collapsing process after the maximum volume thereof after FIG. 2, (*c*) state, a volume of the liquid enough to compensate for the collapsing bubbling volume flows into the bubble generation region from the ejection outlet 18 side of the first liquid flow path 14 and from the bubble generation region of the second liquid flow path 16.

In the case of conventional liquid flow passage structure not having the movable member 31, the amount of the liquid from the ejection outlet side to the bubble collapse position and the amount of the liquid from the common liquid chamber thereinto, are attributable to the flow resistances of the portion closer to the ejection outlet than the bubble generation region and the portion closer to the common liquid chamber.

Therefore, when the flow resistance at the supply port side is smaller than the other side, a large amount of the liquid flows into the bubble collapse position from the ejection outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow $V_{D2}$ through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream ($V_{D2}$) of the second liquid flow path along the surface of the heat generating element side of the movable member 31 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that the vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the resulting inertia force. In this embodiment, these actions to the upstream side are suppressed by the movable member 31, so that the refilling performance is further improved.

The description will be made as to a further characterizing feature and the advantageous effect.

The second liquid flow path 16 of this embodiment has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not disappeared are removed without difficulty, and in addition, the heat accumulation in the liquid is not too much. Therefore, the stabilized bubble generation can be repeated at a high speed. In this embodiment, the liquid supply passage 12 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 2. Then, the flow resistance for the liquid between the bubble generation region 11 and the region of the first liquid flow path 14 close to the ejection outlet is increased by the restoration of the movable member to the first position, so that the flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 6:
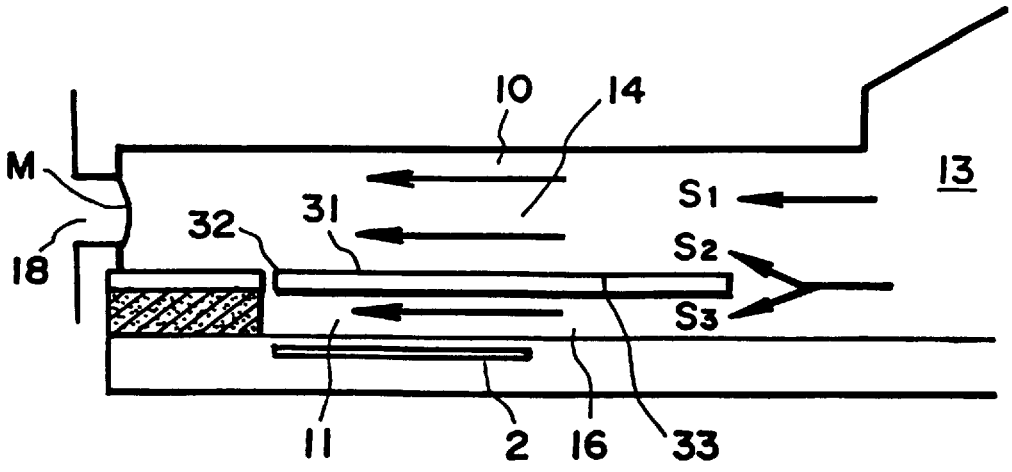
FIG. 6 is a schematic view illustrating flow of the liquid in the ejection principle usable with the present invention.

The positional relation between the free end 32 and the fulcrum 33 of the movable member 31 is such that the free end is at a downstream position of the fulcrum as indicated by 6 in the Figure, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted b the ejection as shown in FIG. 6, returns to the ejection outlet 18 by capillary force or when the liquid supply is effected to compensate for the collapse of bubble, the positions of the free end and the fulcrum 33 are such that the flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

The ejection principle and the structure of the present invention are substantially the same, but the present invention provides a further improvement. The embodiments of the present invention will be described.

In the descriptions of the embodiments, the first liquid flow path 14 and the second liquid flow path 16 are separated by a separation wall 30, but the present invention is usable with various types of the head described in the foregoing.

(Embodiment 1)

Figure 7:
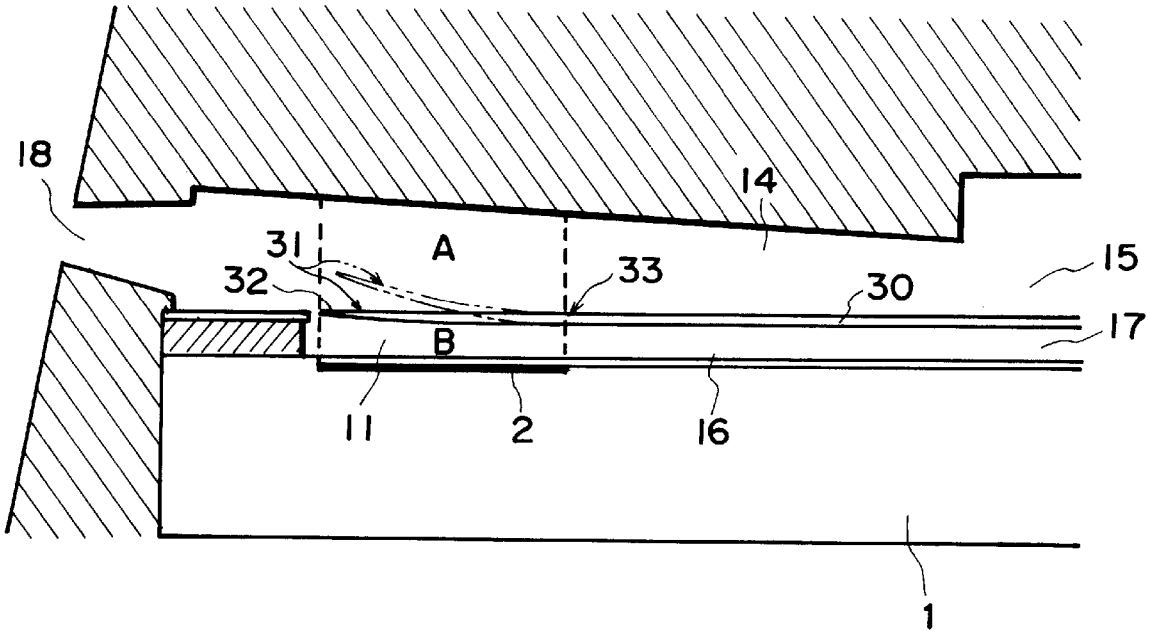
FIG. 7 is a schematic sectional view of a liquid ejecting head according to a first embodiment of the present invention.

FIG. 7 shows a first embodiment. In FIG. 7, A shows an upwardly displaced movable member although bubble is not shown, and B shows the movable member in the initial position (first position) wherein the bubble generation region 11 is substantially sealed relative to the ejection outlet 18. Although not shown, there is a flow passage wall between A and B to separate the flow paths.

In the liquid ejecting head of this embodiment, a second liquid flow path 16 for the bubble generation is provided on the element substrate 1 which is provided with a heat generating element 2 (40×100 μm) for supplying thermal energy for generating the bubble in the liquid, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

The structure of the first path is such that the height thereof gradually increases toward the ejection outlet.

In the case that the bubble generation liquid and ejection liquid are the same liquids, the number of the common liquid chambers may be one.

Between the first and second liquid flow paths, that is, at the position with a space for constituting a second liquid flow path, above an element substrate 1 provided with a heat generating resistor portion as the heat generating element 2 and wiring electrodes (not shown) for applying an electric signal to the heat generating resistor portion, there is a separation wall 30 of an elastic material such as metal so that the first flow path and the second flow path are separated. In the case that mixing of the bubble generation liquid and the ejection liquid should be minimum, the first liquid flow path 14 and the second liquid flow path 16 are preferably isolated by the partition wall. However, when the mixing to a certain extent is permissible, the complete isolation is not inevitable.

A portion of the partition wall in the upward projection space of the heat generating element (ejection pressure generation region including A and B (bubble generation region 11) in FIG. 7), is in the form of a cantilever movable member 31, formed by slits 35, having a fulcrum 33 at the common liquid chamber (15 17) side and free end at the ejection outlet side (downstream with respect to the general flow of the liquid). The movable member 31 is faced to the surface, and therefore, it operates to open toward the ejection outlet side of the first liquid flow path upon the bubble generation of the bubble generation liquid (direction of the arrow in the Figure).

Figure 9:
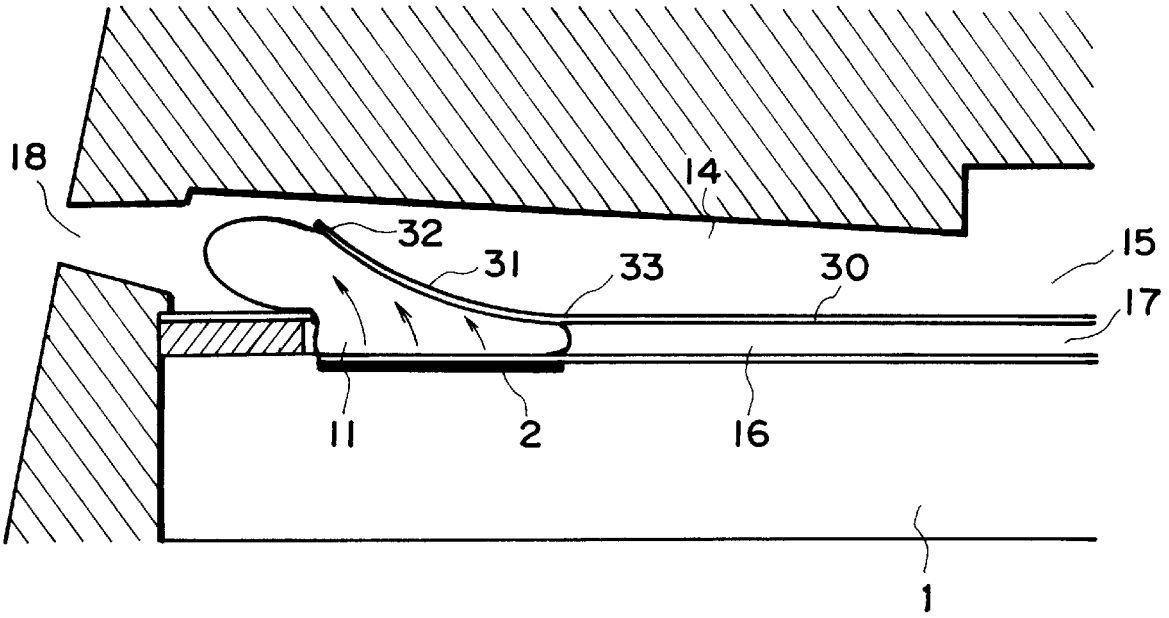
FIG. 9 is a sectional schematic view showing the operation state of the liquid ejecting head of the present invention.

The movable member 31 of this embodiment has a portion with a smaller thickness between the base portion or fulcrum 33 and the free end 32 than at the fulcrum portion. In other words, the change portion is continuous in the movable member. In this embodiment, the fulcrum portion 33 has a thickness of 5 μm, and the thickness continuously or gradually deceases toward the free end having the thickness of 2 μm. With such a structure, displacement of each portion of the movable member in response to the bubble formation by the heat generating element 2 is larger toward the free end side, as compared with the case of uniform or constant thickness. As shown in FIG. 9, the larger displacement can be provided at each portion of the movable member with a larger maximum displacement at the free end, as compared with the movable member having the uniform thickness, so that the pressure and the growth of the bubble upon the bubble generation can be efficiently directed.

The stress occurring in the movable member at the fulcrum portion at this time is distributed widely by the change of the thickness, and therefore, is smaller than that with the uniform thickness. Therefore, the durability of the movable member can be significantly improved. Thus, the ejection efficiency and the ejection pressure can be improved, and simultaneously, the durability of the movable member is improved.

Figure 8:
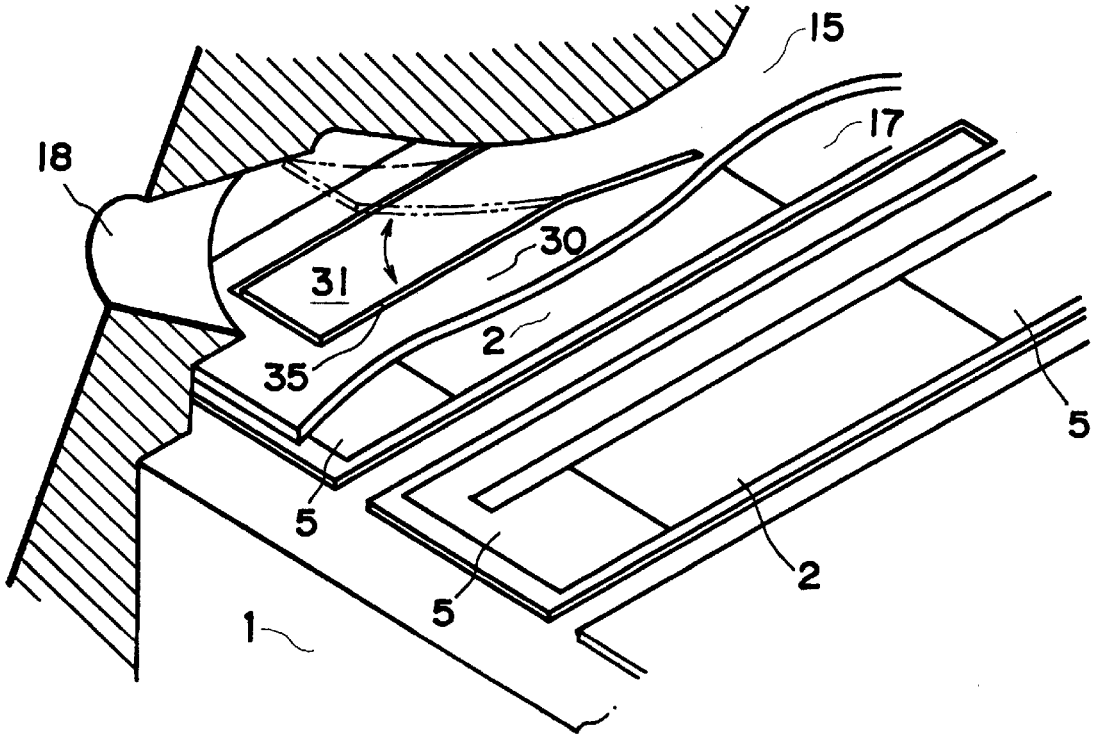
FIG. 8 is a partly broken perspective view of a portion of the liquid ejecting head of the present invention.

As shown in FIG. 8, the change point of the movable member 31 is at such a position as is opposed to the heat generating element 2.

FIG. 10 illustrates the positional relation between the movable member 31 and the second liquid flow path 16, wherein (*a*) is a view of the movable member 31 as seen from the top, and (*b*) is a view of the second liquid flow path as seen from the top with the separation wall 30 removed. In the same Figure, (*c*) schematically shows the positional relation between the movable member 31 and the second liquid flow path 16.

In the same Figure, (*d*) shows an embodiment wherein a change point or portion (inflection point or portion) of the movable member is provided by using different material while the thickness is constant or uniform. The change point can be provided by forming a smaller thickness portion as described above and then planting, into the portion, a material having a smaller elastic modulus or rigid (more easily bending material) than the material of the movable member. The thickness and/or width may be reduced to further provide the change point. The structure shown in (*d*) of the same portion also provides the stress dispersion effects described in conjunction with FIGS. 7–9, and therefore, the same advantageous effects are provided.

In this embodiment, the thickness of the movable member is smaller toward the free end side from the fulcrum portion, and therefore, the free end side of the movable member even more displaces when the movable member is displaced or deflected. Similarly to the above-described, the durability of the fulcrum portion is enhanced, and simultaneously, the ejection efficiency and the ejection power is further improved.

(Embodiment 2)

Figure 11A:
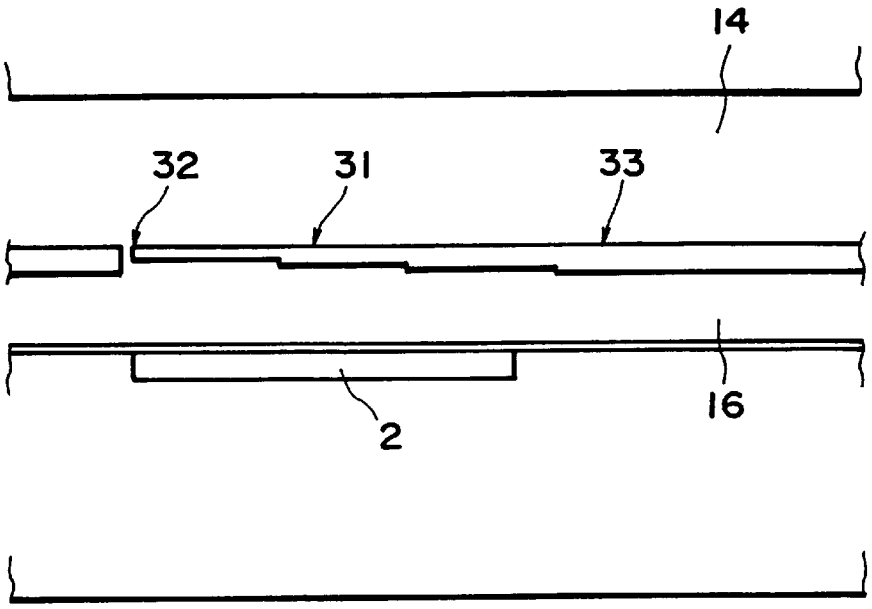
FIG. 11, (*a*), (*b*) and (*c*), are sectional schematic views of other configurations of the movable member usable with the present invention.
Figure 11B:
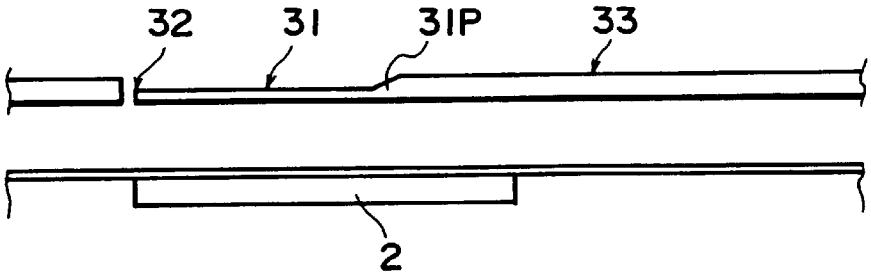
Figure 11C:
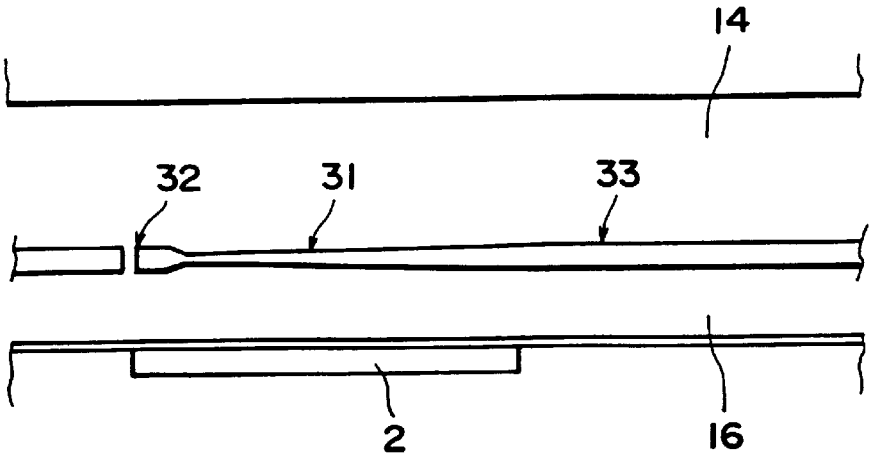

FIG. 11 shows other examples wherein the free end side of the movable member is smaller than at the fulcrum portion. In (*a*) and (*b*) of this Figure, there are shown longitudinal sections of the heads adjacent movable members.

The structures other than the movable member 31 are substantially the same as Embodiment 1, and therefore, the detailed description thereof is omitted for simplicity. In FIG. 11, (*a*), the thickness of the movable member 31 stepwisely decreases from the fulcrum portion toward the free end side, so that a plurality of change portions are provided. In this example, there are a region having a thickness of 2 μm adjacent to the free end portion 32, a region of a thickness of 3 μm through a change portion, a region of 4 μm through a change portion, and a separation wall region having a thickness of 5 μm at the fulcrum portion.

With such a structure, the displacement state of the movable member is such that the degree of the displacement stepwisely changes with the maximum changing rate at the free end side. The movable member configuration of the structure shown in FIG. 11, (*a*) provides a stepwise change of the thickness as compared with the movable member configuration in the foregoing embodiment, so that the boundary portion where the thickness changes provides the change portion (inflection portion), and the manufacturing is easier.

In FIG. 11, (*b*), the thickness of the movable member is reduced by one step from 5 μm (the fulcrum portion thickness) to 2 μm (the free end portion thickness), at a changing position 31P away from the fulcrum portion toward the free end side, so that the displacement at the free end is further increased. The boundary portion where the thickness is changed, provides the change portion, and the change portion is on the bubble generation region so that the ejection efficiency can be increased. The manufacturing is further made easier.

In FIG. 11, (*c*), the thickness of the movable member is reduced from 5 μm to 2 μm toward the free end side, but the thickness is slightly increased adjacent the free end portion. With this decreasing and then increasing thickness structure, the degree of displacement of the movable member as a whole is larger at the portions except for end portion. With such a structure, the displacement at the portion (change portion) where the thickness increases, decreases to suppress excessive displacement at the free end portion. As compared with the first embodiment, the displacement is smaller, but the increased mass at the free end portion of the movable member permits deflection of the movable member like a whip so as to enhance the transmission of the pressure by the mechanical displacement of the movable member. Thus, the free end region is controlled such that the growing direction of the bubble is slightly directed toward the ejection outlet side, by which the ejection efficiency is further stabilized. The durability is improved in any of FIG. 11, (*a*) to (*c*), since the stress concentration can be avoided, or the stress can be scattered or dispersed.

(Embodiment 3)

FIG. 12 is a schematic view illustrating another configuration of the movable member, wherein FIG. 12, (*a*) is a longitudinal sectional view of the head adjacent the movable member, and FIG. 12, (*b*) is a schematic view of the movable member as seen from the top of FIG. 12, (*a*). In this embodiment, similarly to the first embodiment, the fulcrum portion has a thickness of 5 μm and a thickness of 2 μm at the free end portion 32, and the width of the movable member at a position upstream of a position faced to the heat generating element (upstream of the bubble generation region) is smaller (30 μm) than the other portion thickness 40 μm. With such a structure, the displacement of the movable member is made further easier so that the ejection efficiency is further improved, and the displacement is further increased.

FIG. 13, (*a*), (*b*) and (*c*), further show other examples of the configurations of the movable member. In FIG. 13, similarly to the first embodiment, the thickness of the movable member gradually decreases from the fulcrum portion 33 toward the free end portion 32. Since the width of the movable member is larger at the fulcrum portion 33 than at the free end portion 32, the durability of the movable member is improved, and a larger displacement of the movable member is accomplished, thus increasing the ejection efficiency and ejection efficiency.

Particularly, as shown in FIG. 13, (*c*), by the provision of the reduced portion in the movable member, the displacement of the movable member can be increased further without increase of the stress at the fulcrum portion.

(Embodiment 4)

FIG. 14 shows another configuration of the movable member, and in this embodiment, the change portion 100 is provided by a thinner portion of the movable member 31 at a position opposed to the heat generating element (position faced the bubble generation region) (FIG. 14, (*a*)).

With such a structure, as shown in FIG. 14, (*b*), the displacement of the movable member at the free end portion 32 side is made easier so that the bubble generation power is directed more toward the ejection outlet side. At this time, the stress at the fulcrum portion is reduced very much as compare with the case without the change portion, so that the durability of the movable member is improved.

In FIG. 14, designated by S is a stopper corresponding to the "resistance" of the flow path described hereinbefore, and functions to provide an upper limit when the portion between the change portion 100 and the fulcrum 33 displaces. In this embodiment, the stress is further scattered by the stopper S, and the direction of the growth of the bubble is further shifted to the ejection outlet side. The change portion 100 is opposed to the central portion of the heat generating element 2 for bubble formation, so that the downstream portion of the bubble growth mainly contributable to the ejection can be directed to the first liquid flow path 14 side with high efficiency by the large displacement of the leading end portion including the free end 32.

Therefore, in this embodiment, a higher efficiency ejection state can be provided by the stopper S and the change portion 100. The structure of this embodiment without the stopper S, and the structures of the other embodiment with this stopper S, are usable as embodiments of the present invention.

FIG. 15 shows embodiments wherein the above-described change portion 100 is provided upstream of a position opposed to the heat generating element 2, wherein the displacement of the movable member 31 can be increased from a portion closer the fulcrum 33 as compared with the structure of FIG. 14. In FIG. 15, (*a*), the change portion is provided only at one position upstream of a position opposed to the heat generating element, and in FIG. 15, (*b*), the change portions are provided at two positions upstream of a position opposed the heat generating element and at the position opposed to the heat generating element. In FIG. 15, (*b*), the displacement at the free end side can be made larger than in FIG. 15, (*a*).

In this embodiment, the thickness at the change portion of the movable member is 3 $\mu$m, and the thickness at the other portion is 5 $\mu$m.

In FIG. 15, (*a*) and (*b*), the degree of the growth of the bubble and the displacement state of the movable member are shown by broken lines to provided clear comparison.

In FIG. 15, (*a*), the change portion 100 is not opposed to a larger part of the bubble generated by the heat generating element 2, and therefore, the portion of the movable portion between the free end portion 32 and the change portion 100 can be displaced more. Therefore, the entirety of the bubble can be guided to the free end side with high efficiency.

As compared with the structure of FIG. 15, (*a*), the structure of FIG. 15, (*b*) is such that an additional change portion 1001 is provided at a position opposed to the heat generating element in the fulcrum portion 33 side of the movable member 31 beyond the central portion C of the heat generating element 2 with respect to the flow direction of the liquid flow path. The change portion 1001 is effective to quickly and assuredly direct, in the ejection direction, the growth of the center region of the bubble in addition to a downstream half of the bubble which is directly contributable to the ejection by the larger displacement at the free end side of the movable member so that the ejection efficiency is further increased, and the latitude of the head design is increased.

Therefore, in FIG. 15, (*b*), the function of the change portion 1001 is added to the function of the change portion 100 as in FIG. 15, (*a*), so that the ejection is synergeticaly improved.

The change portion 1001 may be added to any of the foregoing embodiments, and it may be removed from the structure of FIG. 15, (*b*).

In the foregoing embodiment, the head is in the form of an edge shooter type, but the present invention is usable with a side shooter type head.

In the foregoing embodiments, and in the following embodiments, the stress can be scattered so that the durability of the movable member can be improved.

(Other Embodiments)

In the foregoing, the description has been made as to the major parts of the liquid ejecting head and the liquid ejecting method according to the embodiments of the present invention. The description will now be made as to further detailed embodiments usable with the foregoing embodiments. The following examples are usable with both of the single-flow-path type and two-flow-path type without specific statement.

<Movable member and partition wall>

FIG. 16 shows another example of the movable member 31, wherein reference numeral 35 designates a slit formed in the partition wall, and the slit is effective to provide the movable member 31. In FIG. 16, (*a*), the movable member has a rectangular configuration, and in (*b*), it is narrower in the fulcrum side to permit increased mobility of the movable member, and in (*c*), it has a wider fulcrum side to enhance the durability of the movable member. The configuration at the fulcrum side is desirable if it does not enter the second liquid flow path side, and motion is easy with high durability.

In the foregoing embodiments, the plate or film movable member 31 has the thickness and configuration as described, and the separation wall 5 having this movable member was made of a nickel having a thickness of 5 $\mu$m in the area not as the movable part, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nitrile group such as acrylonitrile, butadiene, stylene or the like, resin material having amide group such as polyamide or the like, resin material having carboxyl such as polycarbonate or the like, resin material having aldehyde group such as polyacetal or the like, resin material having sulfone group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, poly-sulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used, material and configuration from the standpoint of sufficient strength as the wall and sufficient operativity as the movable member, and generally, 0.5 μm–10 μm approx. is desirable.

The width of the slit 35 for providing the movable member 31 is 2 μm in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. slit is enough to avoid the liquid mixture, but not more than 3 μm is desirable.

<Element substrate>

The description will be made as to a structure of the element substrate provided with the heat generating element for heating the liquid.

Figure 17A:
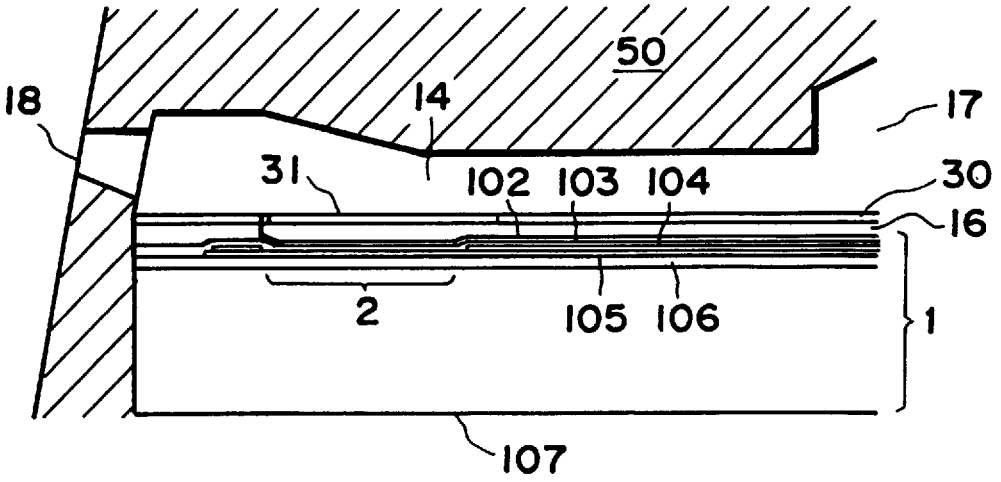
FIG. 17, (*a*) and (*b*), are sectional schematic views illustrating the detail of a section of a liquid ejecting head.
Figure 17B:
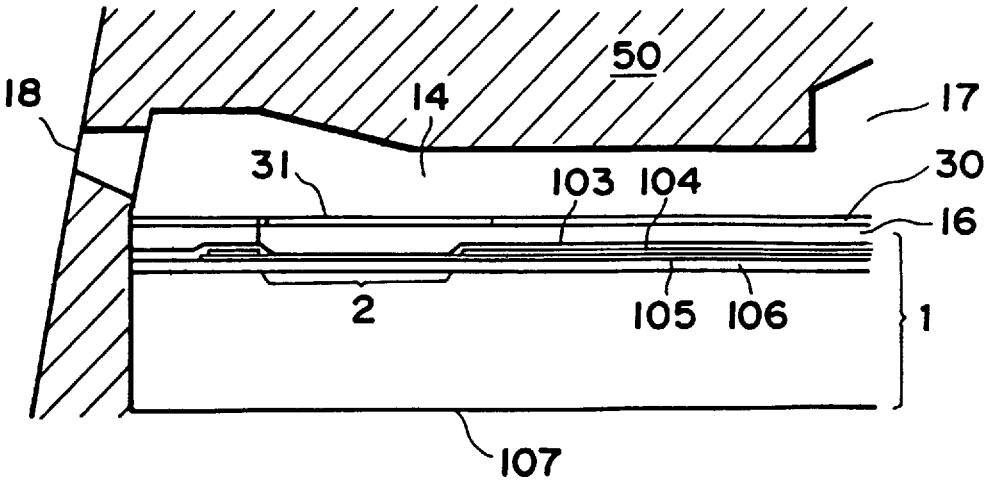

FIG. 17 is a longitudinal section of the liquid ejecting head according to an embodiment of the present invention.

On the element substrate 1, a grooved member 50 is mounted, the member 50 having second liquid flow paths 16, separation walls 30, first liquid flow paths 14 and grooves for constituting the first liquid flow path.

The element substrate 1 has patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink.

The pressure and shock wave generated upon the bubble generation and collapse is so strong that the durability of the oxide film which is relatively fragile is deteriorated. Therefore, metal material such as tantalum (Ta) or the like is used as the anti-cavitation layer.

Figure 19:
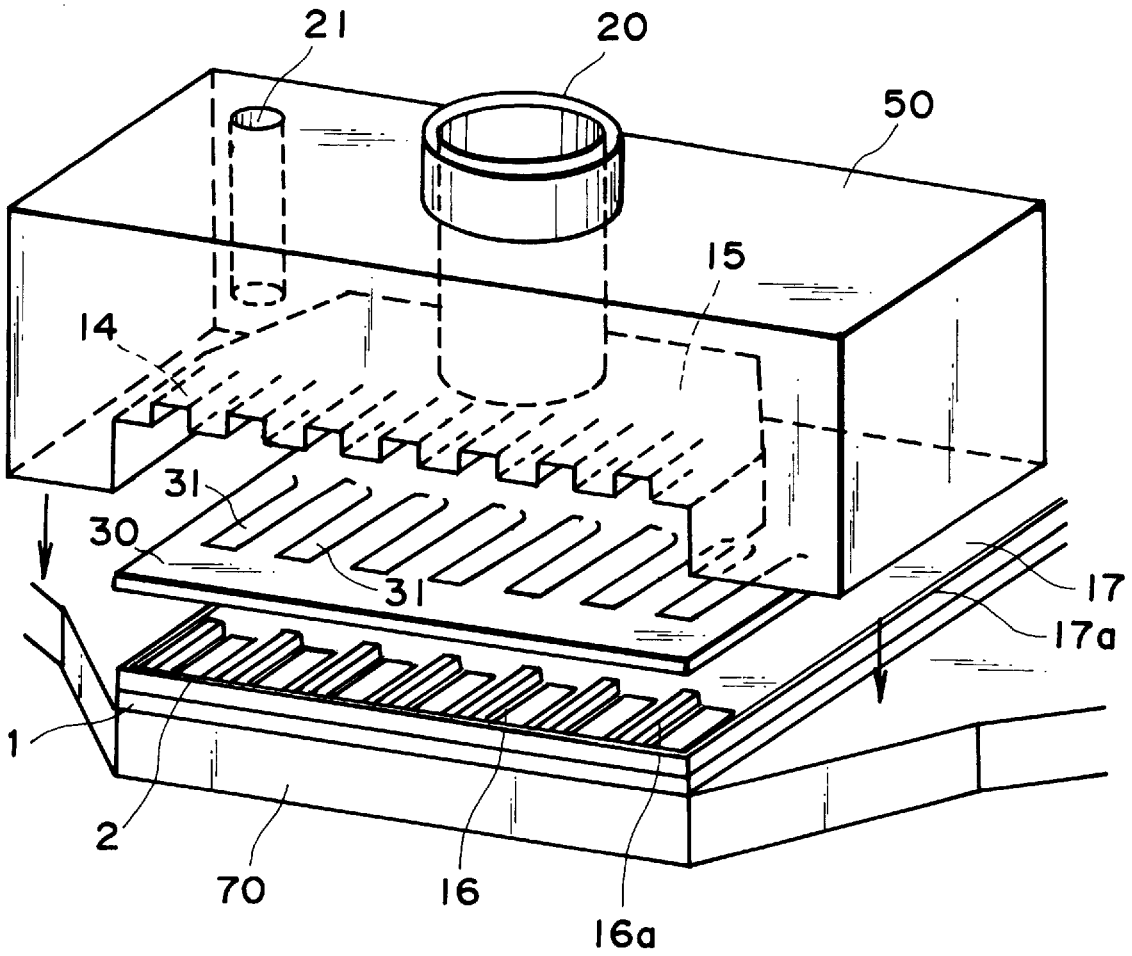
FIG. 19 is a schematic exploded perspective view illustrating major structures of a liquid ejecting head of the present invention.

The protection layer may be omitted depending on the combination of liquid, liquid flow path structure and resistance material. One of such examples is shown in FIG. 19, (*b*). The material of the resistance layer not requiring the protection layer, includes, for example, iridium-tantalum-aluminum alloy or the like. Thus, the structure of the heat generating element in the foregoing embodiments may include only the resistance layer (heat generation portion) or may include a protection layer for protecting the resistance layer.

In the embodiment, the heat generating element has a heat generation resistance lay the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selective driving the electrothermal transducer element may also be integrally built in, in addition to the resistance layer 105 constituting the heat generation portion and the electrothermal transducer constituted by the wiring electrode 104 for supplying the electric signal to the resistance layer.

Figure 18:
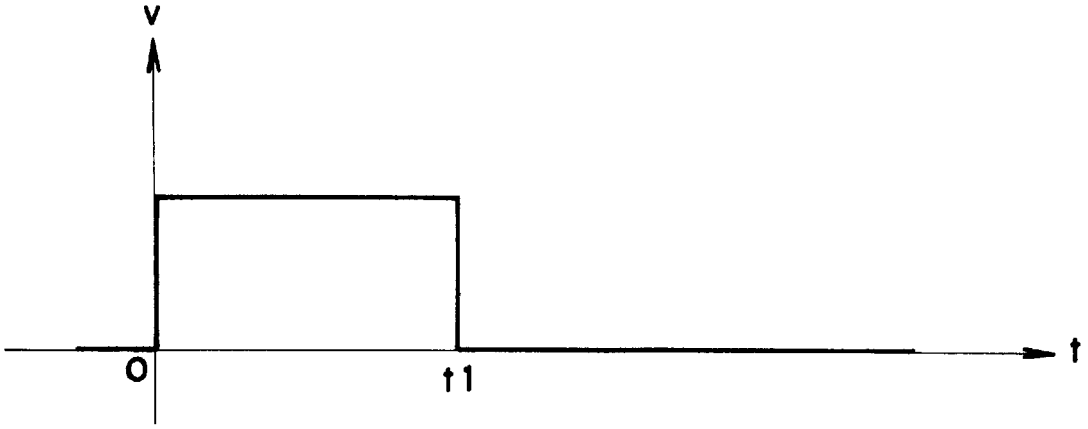
FIG. 18 is a schematic view illustrating a configuration of driving pulse s.

In order to eject the liquid by driving the heat generation portion of the electrothermal transducer on the above-described element substrate 1, the resistance layer 105 is supplied through the wiring electrode 104 with rectangular pulses as shown in FIG. 18 to cause instantaneous heat generation in the resistance layer 105 between the wiring electrode. In the case of the heads of the foregoing embodiments, the applied energy has a voltage of 24 V, a pulse width of 7 μsec, a current of 150 mA and a frequency of 6kHz to drive the heat generating element, by which the liquid ink is ejected through the ejection outlet through the process described hereinbefore. However, the driving signal conditions are not limited to this, but may be any if the bubble generation liquid is properly capable of bubble generation.

<Ejection liquid and bubble generation liquid>

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

| | |
|---|---|
| (C.I. food black 2) dye | 3 wt. % |
| diethylene glycol | 10 wt. % |
| Thio diglycol | 5 wt. % |
| Ethanol | 5 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly ejected, and even 150cps liquid was properly ejected to provide high quality image.

| | |
|---|---|
| Bubble generation liquid 1: | |
| Ethanol | 40 wt. % |
| Water | 60 wt. % |
| Bubble generation liquid 2: | |
| Water | 100 wt. % |
| Bubble generation liquid 3: | |
| Isopropyl alcoholic | 10 wt. % |
| Water | 90 wt. % |
| Ejection liquid 1: | |
| (Pigment ink approx. 15 cp) | |
| Carbon black | 5 wt. % |
| Stylene-acrylate-acrylate ethyl copolymer resin material | 1 wt. % |
| Dispersion material (oxide 140, weight average molecular weight) | |
| Mono-ethanol amine | 0.25 wt. % |
| Glyceline | 69 wt. % |
| Thiodiglycol | 5 wt. % |
| Ethanol | 3 wt. % |
| Water | 16.75 wt. % |
| Ejection liquid 2 (55 cp): | |
| Polyethylene glycol 200 | 100 wt. % |
| Ejection liquid 3 (150 cp): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

<Structure of Twin Liquid Passage Head>

FIG. 19 is an exploded perspective view of the twin passage liquid ejection head in accordance with the present invention, and depicts its general structure.

The aforementioned element substrate 1 is disposed on a supporting member 70 of aluminum or the like. The wall 72 of the second liquid passage and the wall 71 of the second common liquid chamber 17 are disposed on this substrate 1. The partition wall 30, a part of which constitutes a moving member 31, is placed on top of them. On top of this partition wall 30, a grooved member 50 is disposed, which comprises: plural grooves constituting first liquid passages 14; a first common liquid chamber 15; a supply passage 20 for supplying the first common liquid chamber 15 with first liquid; and a supply passage 21 for supplying the second common liquid chamber 17 with second liquid.

<Liquid ejection head cartridge>

The description will be made as to a liquid ejection head cartridge having a liquid ejecting head according to an embodiment of the present invention.

Figure 20:
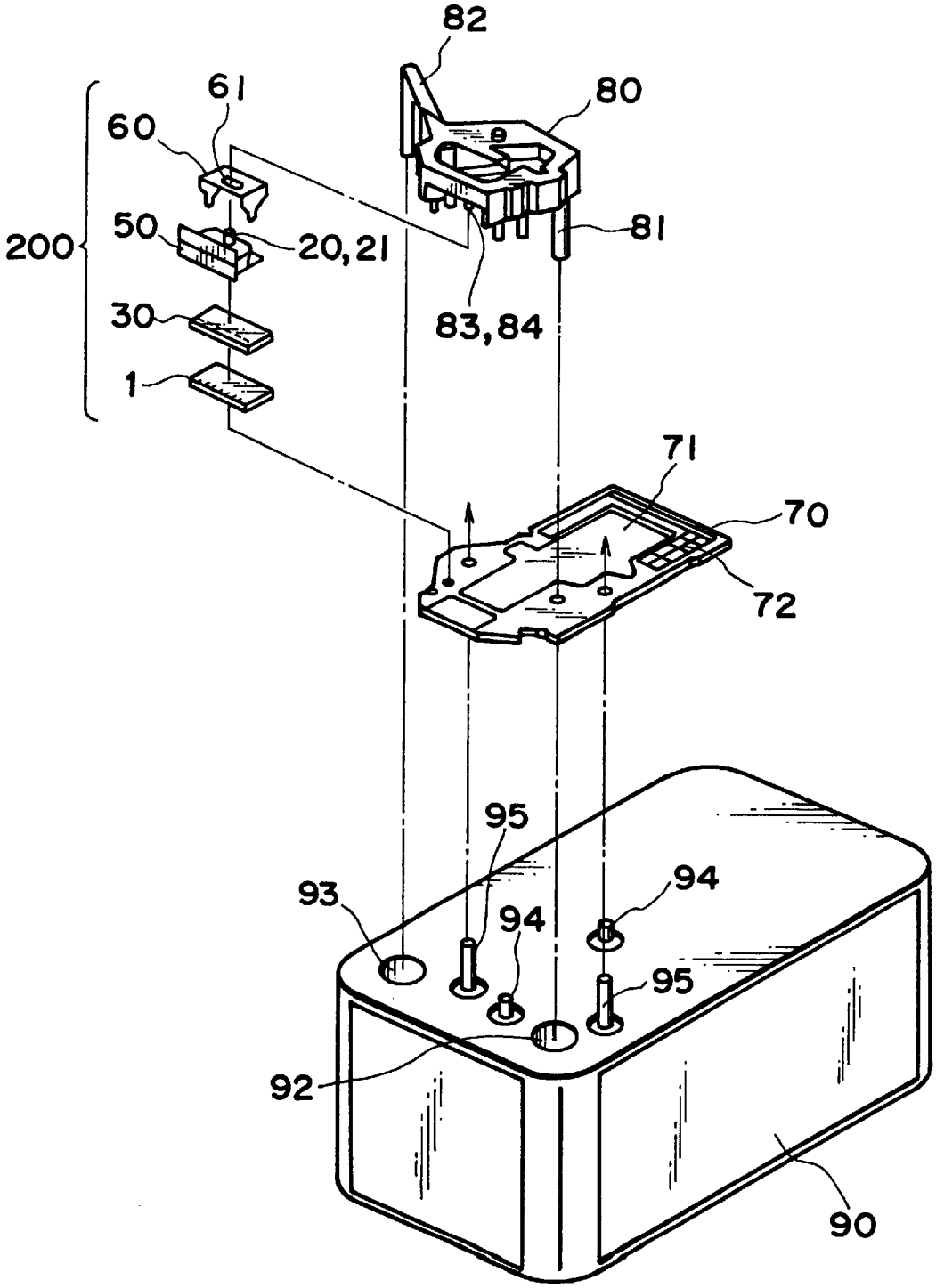
FIG. 20 is a schematic exploded perspective view illustrating a head cartridge having the liquid ejecting head of the present invention.

FIG. 20 is a schematic exploded perspective view of a liquid ejection head cartridge including the above-described liquid ejecting head, and the liquid ejection head cartridge comprises generally a liquid ejecting head portion 200 and a liquid container 80.

The liquid ejecting head portion 200 comprises an element substrate 1, a separation wall 30, a grooved member 50, a confining spring 70, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 70 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the ejection liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 81 of the connecting member from the ejection liquid supply passage 92 of the liquid container, and is supplied to a first common liquid chamber through the ejection liquid supply passage 83, supply and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 22 of the members.

In such a liquid ejection head cartridge, even if the bubble generation liquid and the ejection liquid are different liquids, the liquids are supplied in good order. In the case that the ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and liquid container may be unseparably integral, or may be separable.

<Liquid ejecting device>

Figure 21:
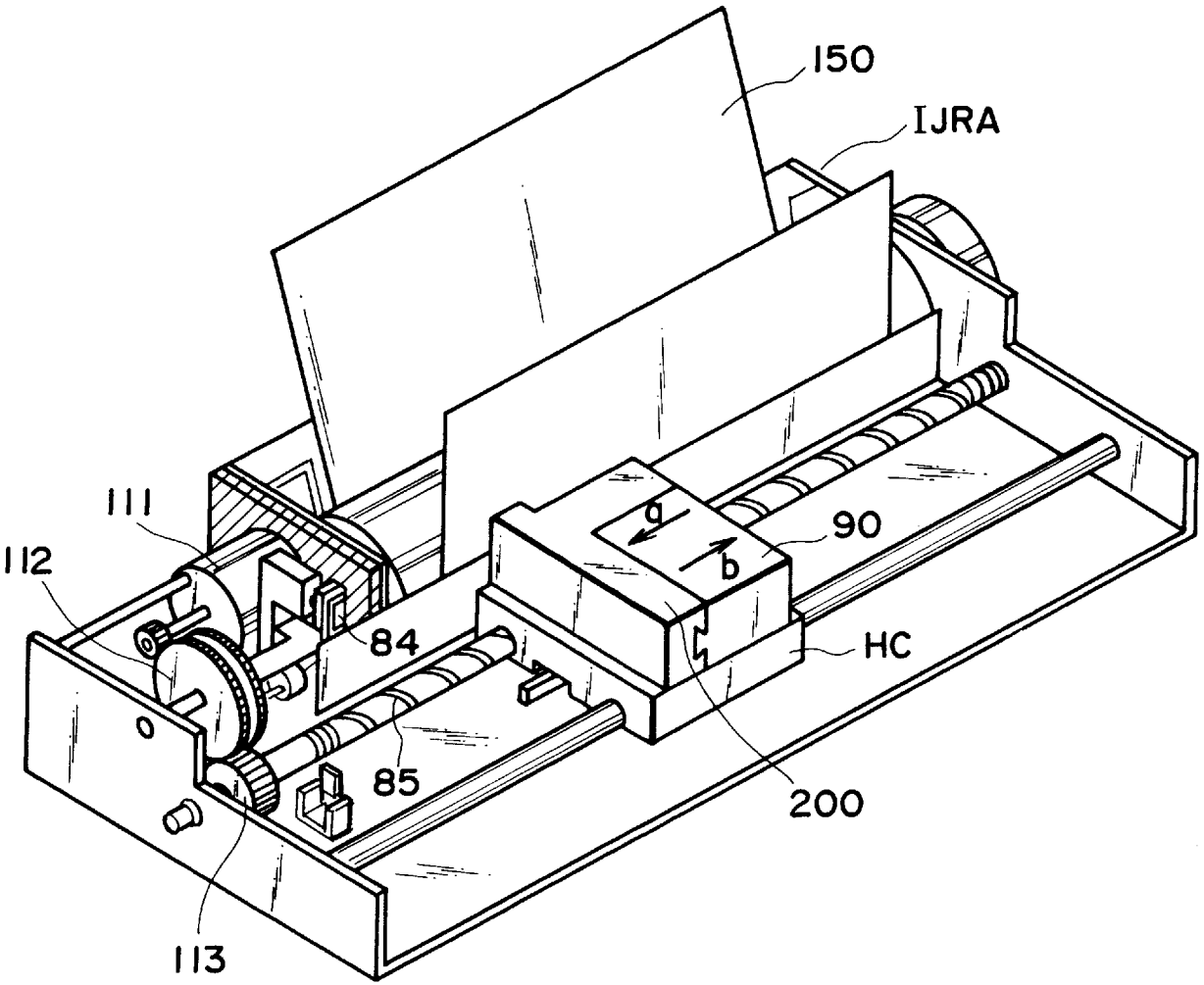
FIG. 21 is a schematic perspective view illustrating example of a liquid ejecting device capable of carrying a liquid ejecting head of the present invention.

FIG. 21 is a schematic illustration of a liquid ejecting device used with the above-described liquid ejecting head. In this embodiment, the ejection liquid is ink, and the apparatus is an ink ejection recording apparatus. The liquid ejecting device comprises a carriage HC to which the head cartridge comprising a liquid container portion 90 and liquid ejecting head portion 200 which are detachably connectable with each other, is mountable. The carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head in response to the signal.

The liquid ejecting apparatus of this embodiment comprises a motor 111 as a driving source for driving the recording material transporting means and the carriage, gears 112, 113 for transmitting the power from the driving source to the carriage, and carriage shaft 115 and so on. By the recording device and the liquid ejecting method using this recording device, good prints can be provided by ejecting the liquid to the various recording material.

Figure 22:
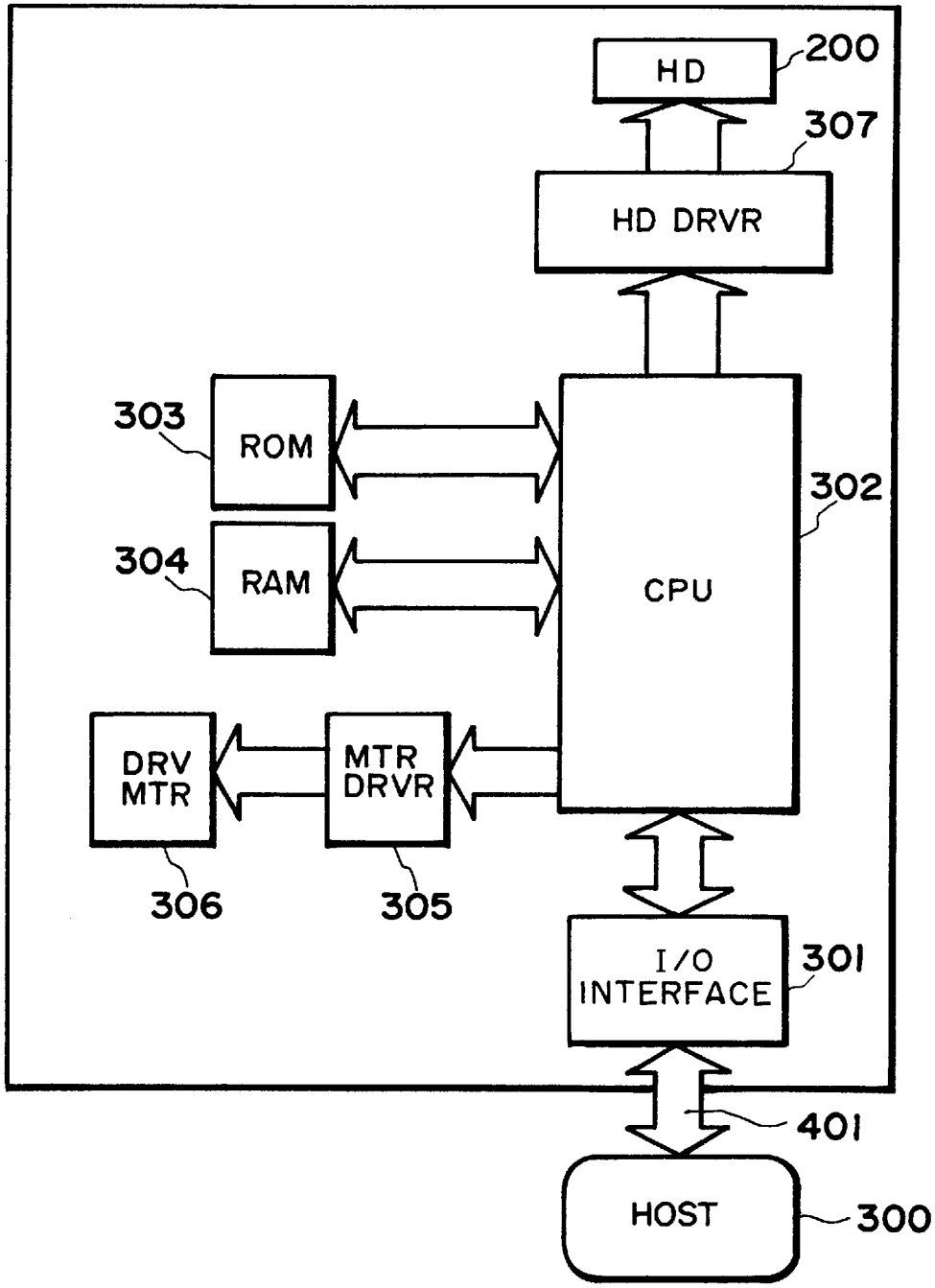
FIG. 22 is a block diagram illustrating a driving means for driving a liquid ejecting device usable with the present invention.

FIG. 22 is a block diagram for describing the general operation of an ink ejection recording apparatus which employs the liquid ejection method, and the liquid ejection head, in accordance with the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

As for recording medium, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

<Recording System>

Next, an exemplary ink jet recording system will be described, which records images on recording medium, using, as the recording head, the liquid ejection head in accordance with the present invention.

Figure 23:
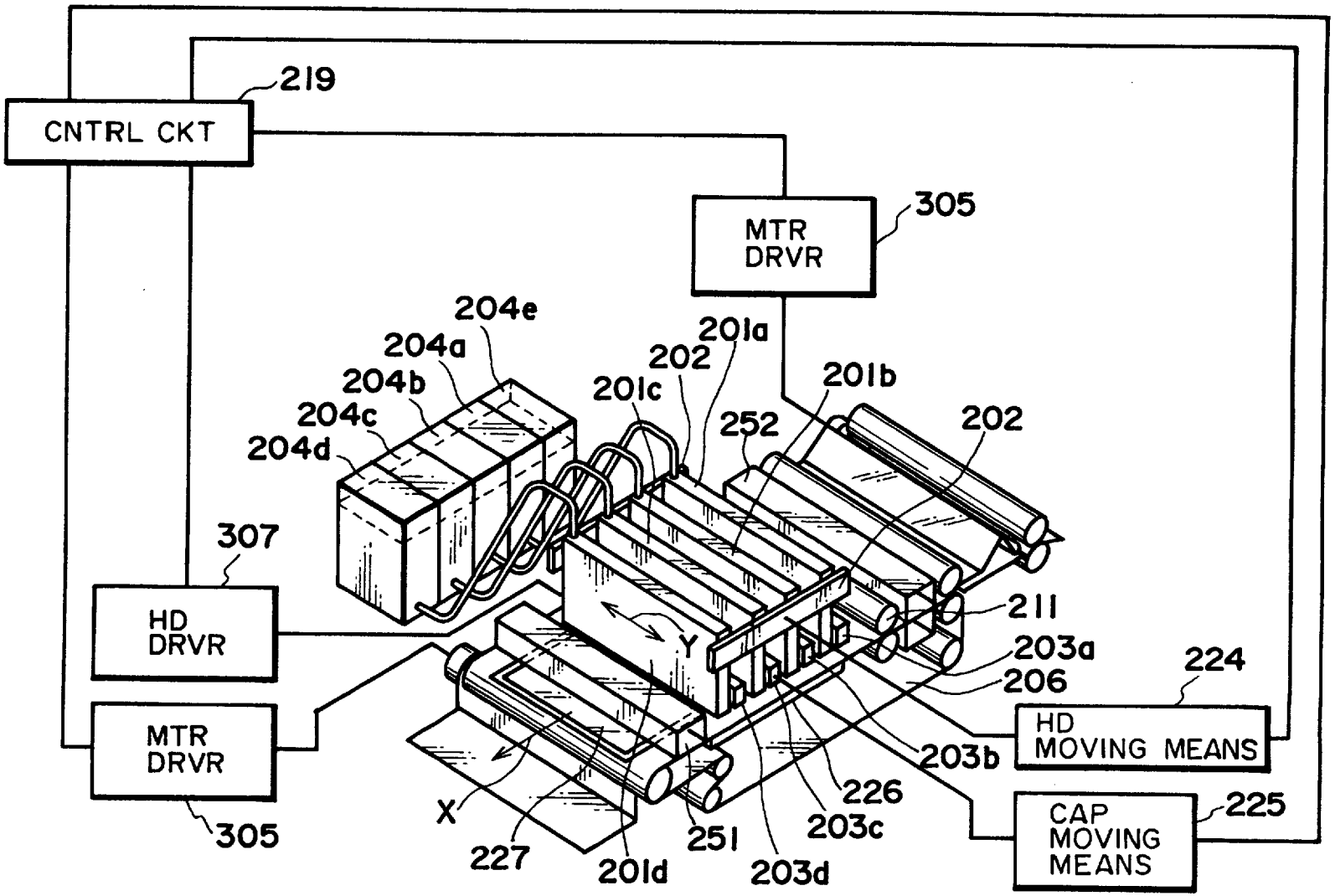
FIG. 23 is a schematic perspective view illustrating a structure of an ink jet recording system using a liquid ejecting head of the present invention.

FIG. 23 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 204*a*, 204*b*, 205*c* or 204*d*. A reference numeral 204*e* designates a bubble generation liquid container from which the bubble generation liquid is delivered to each head.

Below each head, a head cap 203*a*, 203*b*, 203*c* or 203*d* is disposed, which contains an ink absorbing member composed of sponge or the like. They cover the ejection orifices of the corresponding heads, protecting the heads, and also maintaining the head performance, during a non-recording period.

A reference numeral 206 designates a conveyer belt, which constitutes means for conveying the various recording medium such as those described in the preceding embodiments. The conveyer belt 206 is routed through a predetermined path by various rollers, and is driven by a driver roller connected to a motor driver 305.

The ink jet recording system in this embodiment comprises a pre-printing processing apparatus 251 and a post-printing processing apparatus 252, which are disposed on the upstream and downstream sides, respectively, of the ink jet recording apparatus, along the recording medium conveyance path. These processing apparatuses 251 and 252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultraviolet rays and ozone before printing, activating its surface.

In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The preprocessing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

<Head Kit>

Figure 25:
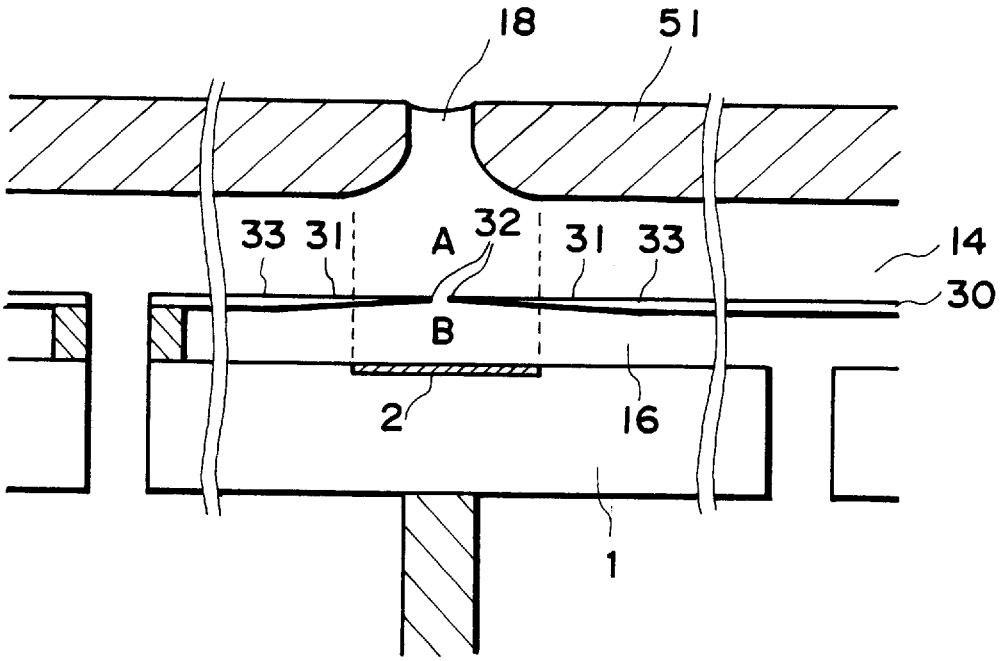
FIG. 25 is a sectional schematic view of a side shooter type head using the present invention.

Hereinafter, a head kit will be described, which comprises the liquid ejection head in accordance with the present invention. FIG. 25 is a schematic view of such a head kit. This head kit is in the form of a head kit package 501, and contains: a head 510 in accordance with the present invention, which comprises an ink ejection section 511 for ejecting ink; an ink container 510, that is, a liquid container which is separable, or nonseparable, from the head; and ink filling means 530, which holds the ink to be filled into the ink container 520.

After the ink in the ink container 520 is completely depleted, the tip 530 (in the form of a hypodermic needle or the like) of the ink filling means is inserted into an air vent 521 of the ink container, the junction between the ink container and the head, or a hole drilled through the ink container wall, and the ink within the ink filling means is filled into the ink container through this tip 531.

When the liquid ejection head, the ink container, the ink filling means, and the like are available in the form of a kit contained in the kit package, the ink can be easily filled into the ink depleted ink container as described above; therefore, recording can be quickly restarted.

In this embodiment, the head kit contains the ink filling means. However, it is not mandatory for the head kit to contain the ink filling means; the kit may contain an exchangeable type ink container filled with the ink, and a head.

Figure 24:
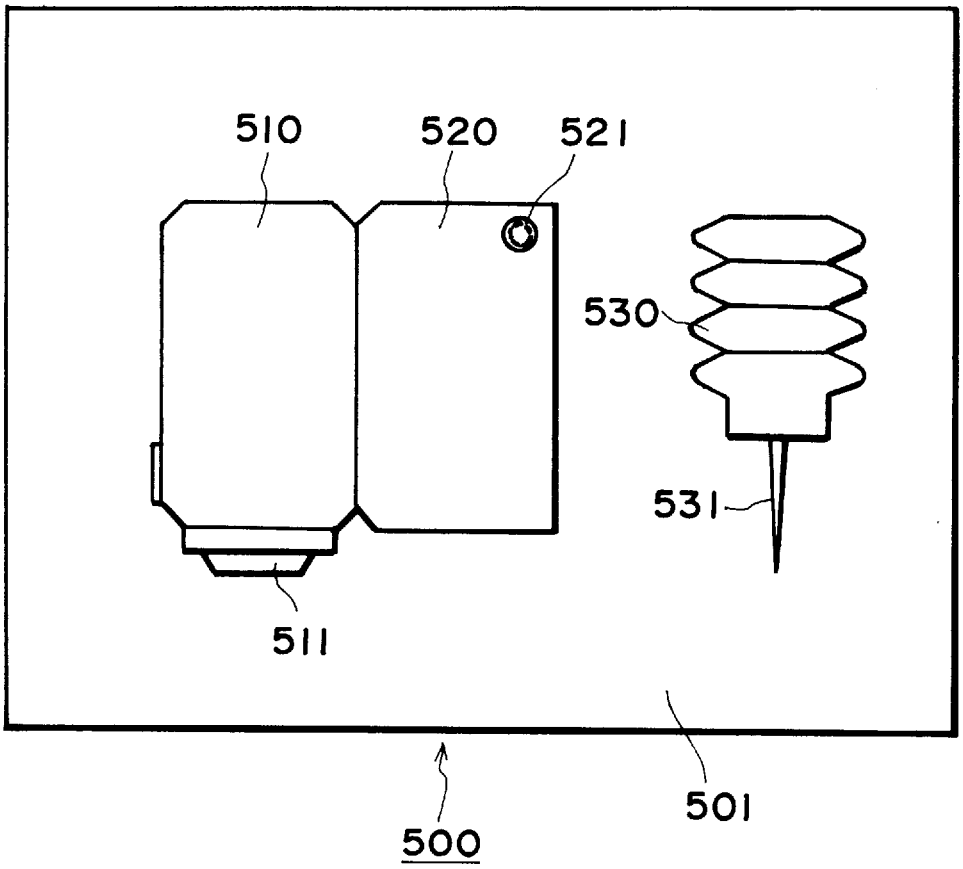
FIG. 24 is a schematic view illustrating a head kit having a liquid ejecting head of the present invention.

Even though FIG. 24 illustrates only the ink filling means for filling the printing ink into the ink container, the head kit may contain means for filling the bubble generation liquid into the bubble generation liquid container, in addition to the printing ink refilling means.

Figure 26:
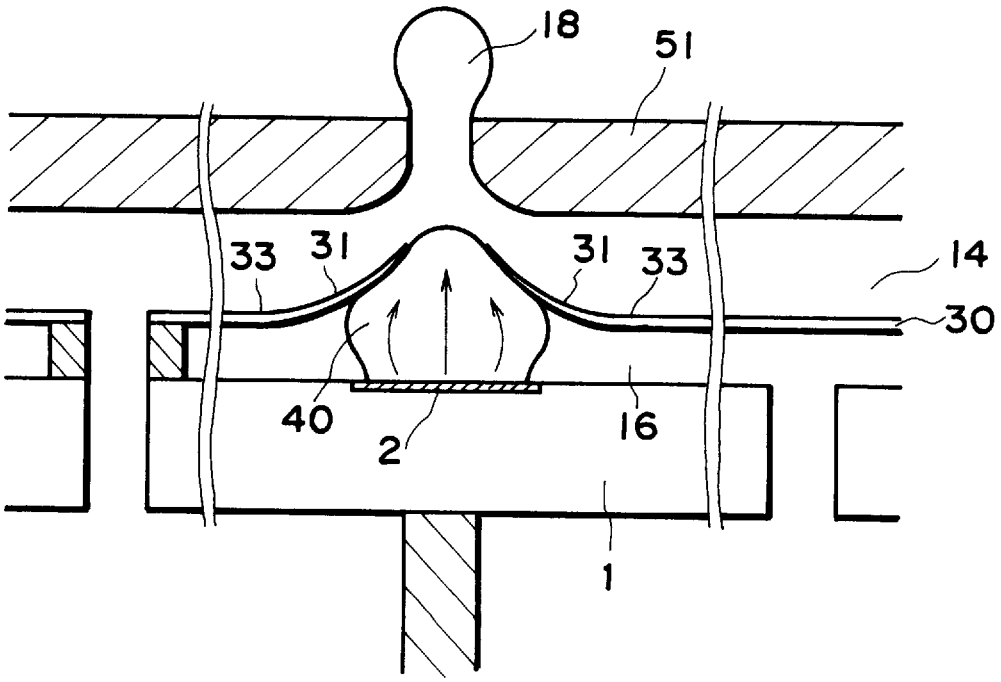
FIG. 26 is a sectional schematic view of a side shooter type head of the present invention, wherein operation state is shown.

The present invention is applicable to a side shooter type as shown in FIGS. 25 and 26, for example, as well as to the head of the edge shooter type. FIGS. 25 and 26 show a head, and FIG. 25 shows the same when the bubble is not generated, and FIG. 26 shows the same when the bubble generation is effected.

In the liquid ejecting head of the side shooter type shown in FIGS. 25 and 26, each ejection outlet is provided with an element substrate 1 provided with a heat generating element 2 for generating thermal heat energy for generating a bubble in the liquid, and a second liquid flow path 16 is formed above the element substrate 1. Above the second liquid flow path 16, a first liquid flow path 14 is formed which is directly in fluid communication with the ejection outlet 11. The first liquid flow path 14 and second liquid flow path 16 are separated by a separation wall 30 of an elastic material such as metal, so that the liquid in the first liquid flow path 14 and the liquid in the second liquid flow path 16 are separated, as in the foregoing liquid ejection head of the edge shooter type.

The side shooter type is different from the edge shooter type, in that the ejection outlet 18 is formed in the orifice plate 51 disposed above the first liquid flow path 14 at a position right above the heat generating element 2. In the separation wall 30 between the ejection outlet 18 and the heat generating element 2, there is provided a pair of movable members, like a double door. More particularly, each of the movable members 31 are in the form of a cantilever, and the free ends thereof are opposed to each other and are slightly spaced apart from each other to form a slit 35 at a position right below the center portion of the ejection outlet 18 when the liquid is not ejected. At the time of ejection, the both movable members 31 provide an opening to the first liquid flow path 14 side by the bubble generation of the bubble generation liquid in the bubble generation region, as shown in FIG. 26.

The first liquid flow path 14, together with the other first liquid flow paths, is in fluid communication with a container (not shown) for retaining the ejection liquid through a first common liquid chamber 15, and the second liquid flow path 16, together with the other second liquid flow paths, is in fluid communication with a container (not shown) for retaining the bubble generation liquid through a second common liquid chamber 17.

The movable member 31 in FIGS. 25 and 26 has a thickness which gradually decreases from the fulcrum portion 33 toward the free end 32.

As will be understood from FIG. 26, the bubble 40 generated by the heating of the liquid by the heat producing member 2, is directed concentratedly toward the ejection outlet 18 with stability. This is because the neighborhood of the free end 32 of the movable members 31 is thin, so that it is easily displaceable toward the ejection outlet 18 by low pressure. The energy required for displacing the movable members 31 is small in the pressure propagation direction of the pressure produced by the bubble 40 and in the direction close thereto. Therefore, the growth of the bubble at the center can be directed toward the ejection outlet 18. As regards the pressure component in the propagation direction significantly different from the direction toward the ejection outlet 18, it is more effectively directed toward the ejection outlet 18 by the thicker portion of the movable member 31. Thus, the degrees of displacements are desirably distributed in connection with the direction of the propagation of the pressure of the bubble 40, and therefore, the energy loss is minimized, so that a high ejection efficiency is provided by efficiently using the entirety of the bubble.

Figure 27:
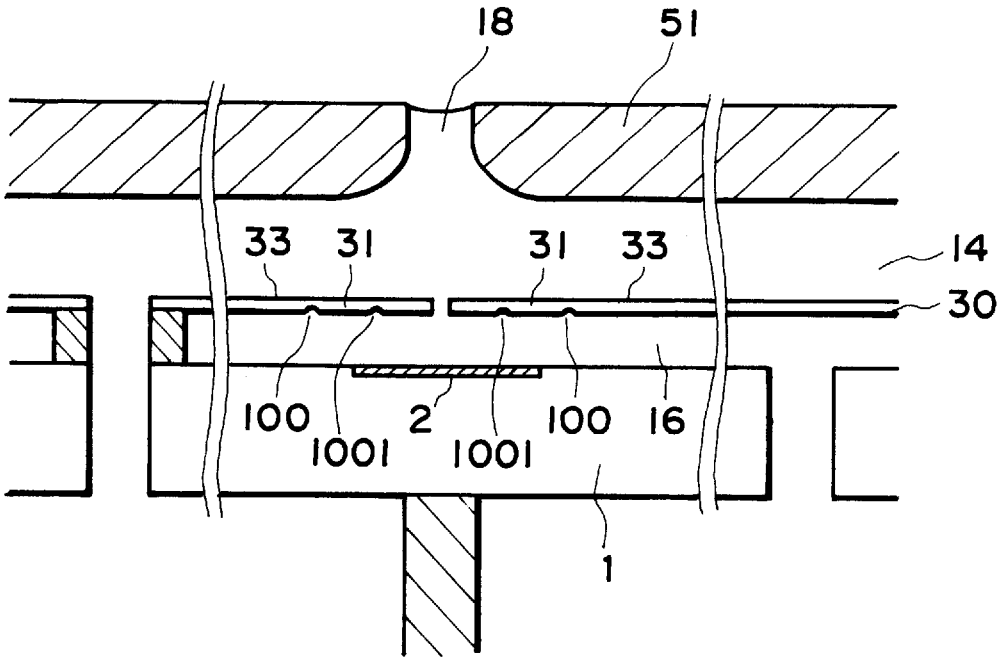
FIG. 27 is a sectional schematic view of an example of a configuration used with a side shooter type head.

FIG. 27 shows a modified example of the above-described embodiment, and a second change portion 1001 is provided in addition to the first change portion 100. In this embodiment, similarly to the foregoing embodiment, the pressure propagation loss is reduced, and the pressure is efficiently directed toward the ejection outlet 18, thus increasing the ejection efficiency. Particularly, the second change portion 1001 located at a position not right above the center of the heat generating element 2 is effective to direct the component of the expansion of the bubble toward the ejection outlet 18 without loss and cooperates with the second change portion 100 at the outside of the portion above the heat generating element 2 increasing the displacement efficiency to stably and concentratedly direct the bubble toward the ejection outlet 18. This will be understood from the description with respect to FIG. 15.

In FIGS. 25–27, similarly to the other embodiments, the ejection efficiency is improved, and the durability is improved by dispersing the deformation of the movable member 31.

Figure 28:
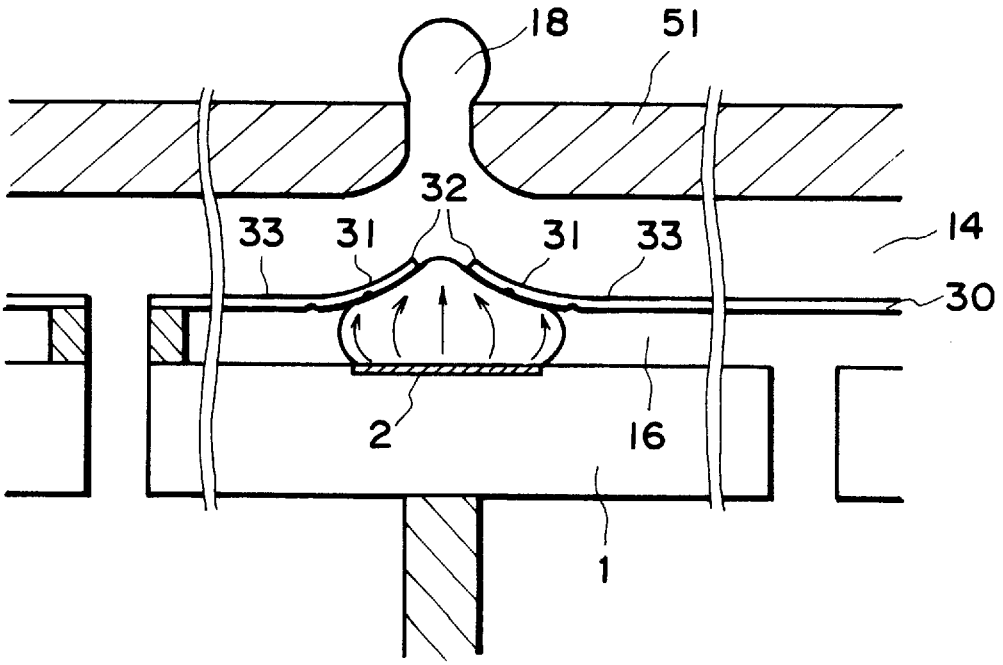
FIG. 28 illustrate a side shooter type head, wherein the movable member has an uniform thickness.

In FIG. 28, the thickness of the movable member is uniform, and the Figure shows the displacement state of the movable member and the control state of the growth of the bubble. When the comparison is made between FIG. 28 and FIG. 26, it will be understood that the structure of FIGS. 26 and 27 accomplishes high efficiency ejection.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejecting head for ejecting liquid by generation of a bubble, comprising:

an ejection outlet through which the liquid is ejected;

a liquid flow path in fluid communication with the ejection outlet;

a bubble generation region for generate the bubble in the liquid;

a movable member disposed opposed to the bubble generation region and provided with a base portion and a free end portion closer to the ejection outlet than the base portion;

wherein the movable member is displaced by a pressure produced by the bubble generated in the bubble generation region to eject the liquid through the ejection outlet;

wherein the movable member has an inflection portion at a portion opposed to the bubble generation region.

2. A liquid ejecting head for ejecting liquid by generation of a bubble, comprising:

an ejection outlet through which the liquid is ejected;

a liquid flow path in fluid communication with the ejection outlet;

a bubble generation region for generate the bubble in the liquid;

a movable member disposed opposed to the bubble generation region and provided with a base portion and a free end portion closer to the ejection outlet than the base portion;

wherein the movable member is displaced by a pressure produced by the bubble generated in the bubble generation region to eject the liquid through said ejection outlet;

wherein the movable member has a portion having a thickness smaller than that at the base portion.

3. A liquid ejecting head for ejecting liquid by generation of a bubble, comprising: an ejection outlet;

a first liquid flow path in fluid communication with said ejection outlet;

a second liquid flow path having a bubble generation region for generating the bubble in the liquid by applying heat in the liquid;

a movable member disposed between the first liquid flow path and the bubble generation region and a free end adjacent said ejection outlet, wherein the free end is displaced into the first liquid flow path by a pressure produced by generation of the bubble in the bubble generation region to direct the pressure toward the ejection outlet of the first liquid flow path;

wherein the movable member has a portion having a thickness smaller than that at the base portion.

4. A liquid ejection head according to claim 2 or 3, wherein the movable member has an inflection portion for changing deformability of the movable member at a position opposed to said bubble generation region.

5. A liquid ejection head according to claim 1, wherein said inflection portion is provided by locally decreasing a thickness of said movable member.

6. A liquid ejection head according to claim 2 or 3, wherein the movable member has a thickness which decreases from a base portion toward the free end portion.

7. A liquid ejection head according to claim 2 or 3, wherein the movable member has a thickness which decreases stepwisely from a base portion toward the free end portion.

8. A liquid ejection head according to claim 2 or 3, wherein the movable member has a thickness which is locally small at a position upstream of a position faced to the bubble generation region.

9. A liquid ejection head according to claim 2 or 3, wherein the movable member has a width which is smaller than that at the base portion.

10. A liquid ejection head according to claim 9, wherein the width decreases toward the free end in a region of said movable member.

11. A liquid ejection head according to claim 9, wherein the movable member has a width which is locally small.

12. A liquid ejection head according to claim 9, wherein the movable member has a width which is locally small at a position upstream of a portion faced to the bubble generation region.

13. A liquid ejection head according to claim 2 or 3, wherein the bubble is expanded more toward said ejection outlet.

14. A liquid ejection head according to claim 2 or 3, wherein said heat generating element is disposed at a position faced to the movable member, and said bubble generation region is defined by said movable member and said heat generating element.

15. A liquid ejection head according to claim 14, wherein the liquid flow path has a supply passage for supplying the liquid onto the heat generating element from an upstream side of said heat generating element along the heat generating element.

16. A liquid ejection head according to claim 15, wherein the supply passage includes a substantially flat or smooth surface inner wall at a position upstream of said heat generating element and supplies the liquid onto the heat generating element along the inner wall.

17. A liquid ejection head according to claim 14, further comprising a liquid flow path for supplying the liquid onto the heat generating element from an upstream side along a surface of the movable member closer to the heat generating element.

18. A liquid ejection head according to claim 14, further comprising a liquid flow path for supplying the liquid onto the heat generating element from an upstream side along a surface of the movable member closer to the heat generating element.

19. A liquid ejection head according to claim 2 or 3, wherein the movable member is in the form of a plate.

20. A liquid ejection head according to claim 19, wherein the whole surface of the heat generating element is faced to the movable member.

21. A liquid ejection head according to claim 19, wherein a total area of the movable member is larger than a total area of the heat generating element.

22. A liquid ejection head according to claim 19, wherein the base portion of the movable member is disposed at a position out of a portion right above the heat generating element.

23. A liquid ejection head according to claim 19, wherein the free end of the movable member has such a configuration that it extends substantially perpendicular to the liquid flow path in which the heat generating element is disposed.

24. A liquid ejection head according to claim 19, wherein the free end of the movable member is disposed at a position closer to the ejection outlet than the heat generating element.

25. A liquid ejection head according to claim 19, wherein the movable member constitutes a part of said separation wall disposed between the first flow path and second flow path.

26. A liquid ejection head according to claim 25, wherein the separation wall is of metal, resin material or ceramic.

27. A liquid ejection head according to claim 3, further comprising a first common liquid chamber for supplying first liquid to a plurality of the first liquid flow paths, and a second common liquid chamber for supplying second liquid to a plurality of the second liquid flow paths.

28. A liquid ejection head according to claim 3, wherein the liquid supplied to the first liquid flow path and the liquid supplied to the second liquid flow path are the same liquids.

29. A liquid ejection head according to claim 3, wherein the liquid supplied to the first liquid flow path and the liquid supplied to the second liquid flow path are different liquids.

30. A liquid ejection head according to claim 14, wherein the heat generating element is in the form of an electrothermal transducer having a heat generating resistor for generating heat upon electric signal supplied thereto.

31. A liquid ejection head according to claim 3, wherein the second liquid flow path has a chamber-like configuration in a portion where the heat generating element is disposed.

32. A liquid ejection head according to claim 3, wherein the second flow path has a configuration with throat portion upstream of said heat generating element.

33. A liquid ejection head according to claim 2 or 3, wherein a distance from a surface of the heat generating element to the movable member is not more than 30 $\mu$m.

34. A liquid ejection head according to claim 2 or 3, wherein the liquid ejected from the ejection outlet is ink.

35. A liquid ejecting method for ejecting liquid by generation of a bubble, using a liquid ejecting head having an ejection outlet for ejecting the liquid, a bubble generation region for generating the bubble in the liquid, and a movable member provided with a base portion and a free end at a position closer the ejection outlet than the base portion;

wherein the movable member is displaced by a pressure produced by the bubble generated in the bubble generation region to eject the liquid through said ejection outlet, wherein the movable member has an inflection portion for changing deformability of the movable member at a position opposed to said bubble generation region.

36. A liquid ejecting method for ejecting liquid by generation of a bubble, using a liquid ejecting head having an ejection outlet for ejecting the liquid, a bubble generation region for generating the bubble in the liquid, and a movable member provided with a base portion and a free end at a position closer the ejection outlet than the base portion;

wherein the movable member is displaced by a pressure produced by the bubble generated in the bubble generation region to eject the liquid through said ejection outlet, wherein said movable member has a portion having a thickness smaller than that at the base portion.

37. A liquid ejection method according to claim 35 or 36, wherein the bubble is expanded more toward said ejection outlet.

38. A liquid ejection method according to claim 36, wherein the bubble is expanded beyond the first position.

39. A liquid ejection method according to claim 36, wherein the bubble is expanded more toward said ejection outlet.

40. A liquid ejection method according to claim 36, wherein said heat generating element is disposed at a position faced to the movable member, and said bubble generation region is defined by said movable member and said heat generating element.

41. A liquid ejection method according to claim 37, wherein a part of the bubble expands into the first liquid flow path with the displacement of the movable member.

42. A liquid ejection method according to claim 40, wherein the bubble is generated by film boiling phenomenon by heat generated by the heat generating element.

43. A liquid ejection method according to claim 40, wherein the liquid is supplied onto the heat generating element along an upstream substantially flat or smooth surface inner wall.

44. A liquid ejection method according to claim 36, wherein the liquid ejected through the ejection outlet is ink.

45. A head cartridge comprising:

a liquid ejecting head as defined in claim 1 or 2; and a liquid container for maintaining the liquid to be supplied to said liquid ejection head.

46. A head cartridge according to claim 45, wherein the liquid ejecting head and the liquid container are separable from each other.

47. A liquid ejecting device for ejecting recording liquid by generation of a bubble, comprising: a liquid ejecting head as defined in claim 1, 2 or 3;

driving signal supply means for supplying a driving signal for ejecting the liquid from the liquid ejecting head.

48. An apparatus according to claim 47, wherein a plurality of the ejection outlets are disposed substantially over an entire width of a recordable region of the recording material.

49. A liquid ejection head according to claim 1, further comprising a heat generating element at least a part of which is faced to said movable member, wherein said heat generating element produces film boiling to create a bubble, and wherein said movable member is provided in a range faced to said heat generating element and in an upstream range of a center of said heat generating element.

50. A liquid ejection head according to claim 1 or 49, wherein said movable member substantially harmetically seal said bubble generation region from said liquid flow path, and opens the bubble generation region by generation of the bubble.

51. A liquid ejection head according to claim 2, further comprising a heat generating element at least a part of which is faced to said movable member, wherein said heat generating element produces film boiling to create a bubble, and wherein said movable member is provided outside a range faced to said heat generating element and in a range between the base portion and the portion opposed to said heat generating element.

52. A liquid ejection head, comprising:

a substrate having a heat generating surface for generating heat for generating a bubble in liquid, wherein said substrate is faced to a liquid ejection outlet;

a movable member having a free end displaceable by the bubble, disposed between the heat generating surface and the ejection outlet;

an opposing member, opposed to such a side of the movable member as is faced to the heat generating surface upon displacement of the free end by the bubble, said opposing member cooperating with the movable member upon the displacement to direct the bubble toward the ejection outlet.

53. A liquid ejection method, wherein a liquid flow path is formed by opposing a substrate having a heat generating surface for generating heat for generating a bubble in liquid to an ejection outlet member provided with an ejection outlet for ejecting the liquid therethrough, with a movable member having a free end disposed therebetween, wherein a liquid flow path side surface of the substrate and a liquid flow path side surface of said ejection outlet member are not crossed in said liquid flow path, and wherein the liquid is ejected by generation of the bubble through the ejection outlet;

wherein the free end of the movable member is disposed downstream side with respect to the supply direction of the liquid to the ejection outlet, in the liquid flow path; and wherein the bubble displaces the free end of the movable member, and in accordance with the displacement, growth of bubble is permitted toward the ejection outlet to eject the liquid.

54. A liquid ejecting head for ejecting liquid by generation of a bubble, comprising:

an ejection outlet through which the liquid is ejected;

a liquid flow path in fluid communication with the ejection outlet;

a bubble generation region for generate the bubble in the liquid;

a movable member disposed opposed to the bubble generation region and provided with a base portion and a free end portion closer to the ejection outlet than the base portion;

wherein the movable member is displaced by a pressure produced by the bubble generated in the bubble generation region to eject the liquid through the ejection outlet;

wherein the movable member has a displacement promoting portion, provided at a position opposed to said bubble generating region, for providing displacement of said movable member, which displacement is larger than a displacement of said movable member without said displacement promoting portion.

* * * * *

UNITED STATES PATENT AND TRADEMARK OFFICE

CERTIFICATE OF CORRECTION

PATENT NO. : 5,821,962 Page 1 of 7

DATED : October 13, 1998

INVENTOR(S) : KUDO ET AL.

It is certified that error appears in the above-identified patent and that said Letters Patent is hereby corrected as shown below:

[57] ABSTRACT:

Line 4, "for generate" should read --that generates--.

COLUMN 1:

Line 17, "tion" should read --ing--.

Line 45, "With such" should read --Such--.

COLUMN 2:

Line 6, "propose" should read --proposes--.

Line 9, "are" should read --is--.

Line 22, "occurs" should read --occurring--.

Line 57, "the" should be deleted.

COLUMN 3:

Line 19, "reduction" should read --reduced--.

Line 45, "generate" should read --generating--.

Line 59, "generate" should read --generating--.

UNITED STATES PATENT AND TRADEMARK OFFICE

CERTIFICATE OF CORRECTION

PATENT NO. : 5,821,962

DATED : October 13, 1998

INVENTOR(S) : KUDO ET AL.

It is certified that error appears in the above-identified patent and that said Letters Patent is hereby corrected as shown below:

COLUMN 4:

Line 20, "ejection" (first occurrence) should read --ejected--.

Line 41, "function" should read --functions--.

COLUMN 5:

Line 2, "stopper," should read --stopper, or--.

Line 4, "herein after" should read --hereinafter--.

Line 15, "and (d)" should be deleted.

Figure 10D:
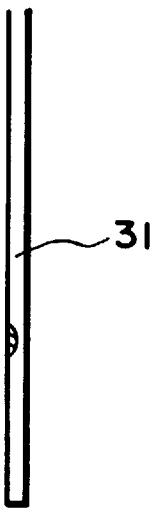
FIG. 10, (*a*), (*b*), (*c*) and (*d*) are top plan views illustrating structures of a movable member and a second liquid flow path in a liquid ejecting head according to an embodiment of the present invention.
Figure 10C:
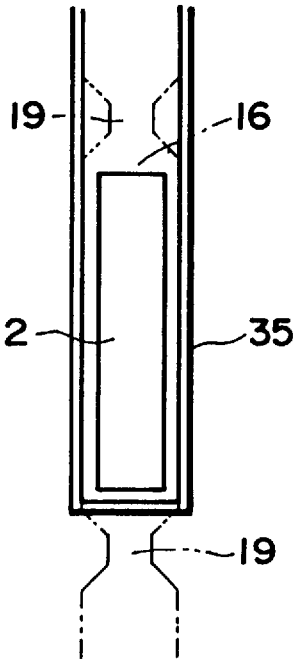
Figure 10B:
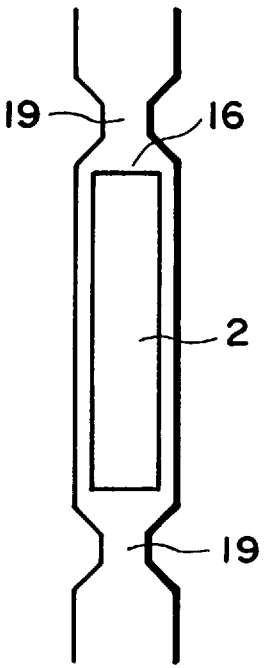
Figure 10A:
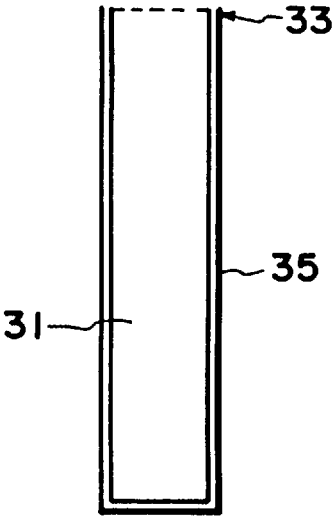

Lines 40, after "invention." the following sentence should be inserted:

--FIG. 10(d) is a side view illustrating the movable member according to an embodiment of the present invention.--.

Figure 14A:
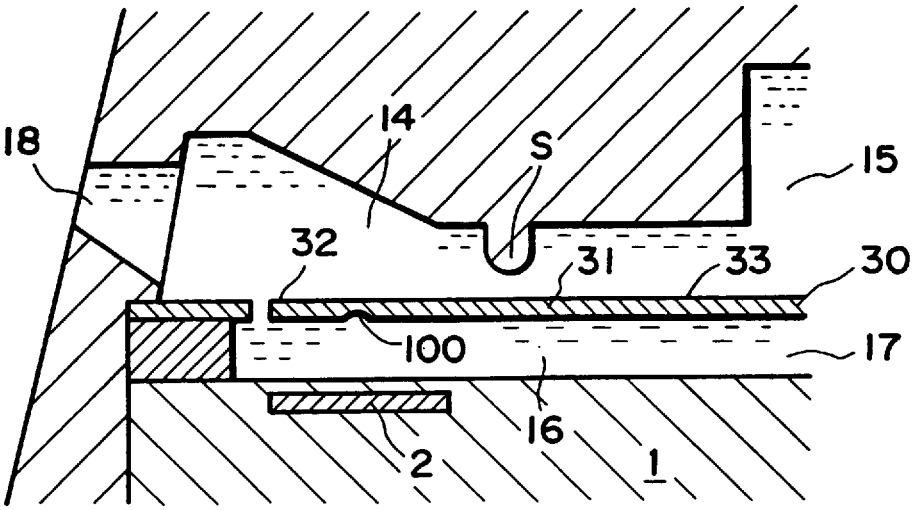
FIG. 14 (*a*) is a show schematic view illustrating an example of a configuration of a movable member having a change portion of the present invention, and liquid ejecting head shows a stationary state, and (*b*) shows an operation state.
Figure 14B:
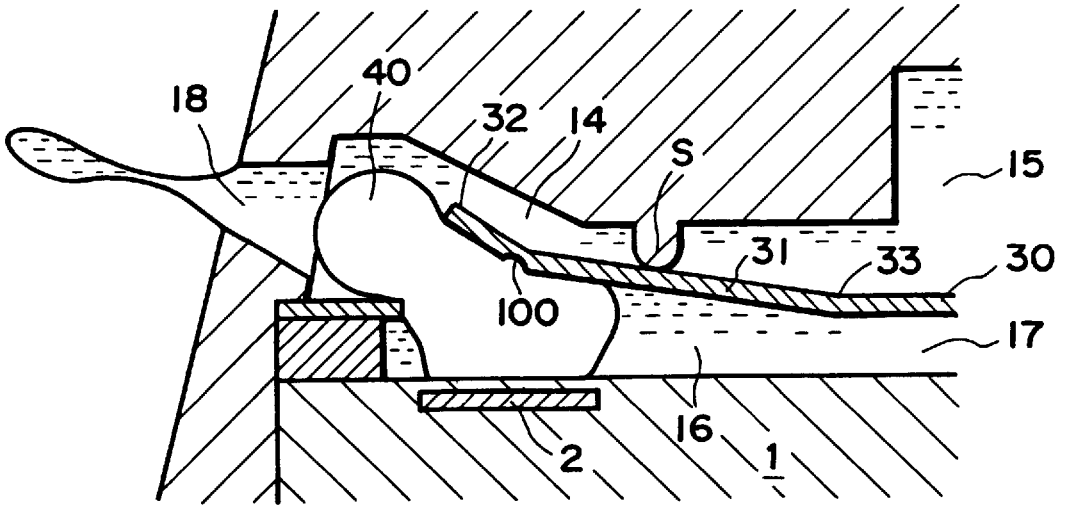

Line 50, "FIG. 14(a) is a show schematic view" should read --FIGS. 14(a) and 14(b) are schematic views--.

Line 52, "and liquid ejecting" should be deleted.

Line 53, "head" should read --FIG. 14(a)--, and "(b)" should read --FIG. 14(b)--.

UNITED STATES PATENT AND TRADEMARK OFFICE

CERTIFICATE OF CORRECTION

PATENT NO. : 5,821,962 Page 3 of 7

DATED : October 13, 1998

INVENTOR(S) : KUDO ET AL.

It is certified that error appears in the above-identified patent and that said Letters Patent is hereby corrected as shown below:

Line 55, "view" should read --views--.

Line 58, "view" should read --views--; and "a" should be deleted.

COLUMN 6:

Line 23, "illustrate" should read --illustrates--.

Line 24, "an" should read --a--.

COLUMN 7:

Line 44, "of the" should be deleted.

COLUMN 9:

Line 7, "$V_{D1}$," should read --$V_{D1}$--.

COLUMN 11:

Line 8, "by 6" should be deleted.

Line 17, "b" should read --by--.

COLUMN 12:

Line 32, "(15 17) should read --(15, 17)--.

Line 45, "deceases" should read --decreases--.

UNITED STATES PATENT AND TRADEMARK OFFICE

CERTIFICATE OF CORRECTION

PATENT NO. : 5,821,962 Page 4 of 7

DATED : October 13, 1998

INVENTOR(S) : KUDO ET AL.

It is certified that error appears in the above-identified patent and that said Letters Patent is hereby corrected as shown below:

COLUMN 14:

Line 60, "compare" should read --compared--.

COLUMN 15:

Line 17, "closer" should read --closer to--.

Line 22, "opposed" should read --opposed to--.

Line 31, "provided" should read --provide--.

COLUMN 17:

Line 2, "used," should read --used--.

Line 49, "FIG. 19," should read --FIG. 17,--.

Line 58, "resistance lay" should read --portion having--.

COLUMN 18:

Line 42, "includes:" should read --include:--.

COLUMN 19:

Before Line 1, --Dye ink viscosity of 2 cp:-- should be inserted.

Line 52, "FIG. 19" should read --FIG. 20--.

Line 67, "liquid." should read --liquid, as shown in FIG. 19.--.

UNITED STATES PATENT AND TRADEMARK OFFICE

CERTIFICATE OF CORRECTION

PATENT NO. : 5,821,962 Page 5 of 7

DATED : October 13, 1998

INVENTOR(S) : KUDO ET AL.

It is certified that error appears in the above-identified patent and that said Letters Patent is hereby corrected as shown below:

COLUMN 20:

Line 12, "70," should read --60,--.

Line 22, "70" should read --60--.

Line 45, "supply and 21" should read --and supply passage 21--.

COLUMN 21:

Line 17, "115" should be deleted.

COLUMN 22:

Line 15, "1202," should read --202,--.

COLUMN 23:

Line 12, "25" should read --24--.

COLUMN 25:

Line 12, "generate" should read --generating--.

Line 29, "generate" should read --generating--.

Line 50, "and a free" should read --and provided with a base portion and a free--.

Line 67, "a" should read --the--.

UNITED STATES PATENT AND TRADEMARK OFFICE

CERTIFICATE OF CORRECTION

DATED : October 13, 1998

INVENTOR(S) : KUDO ET AL.

It is certified that error appears in the above-identified patent and that said Letters Patent is hereby corrected as shown below:

COLUMN 26:

Line 3, "a" should read --the--.

Line 25, "said" should read --a--.

Line 44, "14," should read --15,--.

COLUMN 27:

Line 1, "19," should read --3,--.

Line 2, "member constitutes" should read --member is in the form of a plate and constitutes--, and "said" should read --a--.

Line 25, "throat" should read --a throat--.

Line 26, "said" should read --a--.

Line 28, "the" should read --a--.

Line 37, "closer" should read --closer to--.

Line 61, "the first" should read --a first--.

Line 66, "said" should read --a--.

COLUMN 28:

Line 4, "the" (second occurrence) should read --a--.

Line 23, "comprising: a" should read --comprising:--, and "a" should begin a new paragraph.

Line 24, "3;" should read --3; and--.

Line 40, "seal" should read --seals--.

UNITED STATES PATENT AND TRADEMARK OFFICE

CERTIFICATE OF CORRECTION

PATENT NO. : 5,821,962 Page 7 of 7

DATED : October 13, 1998

INVENTOR(S) : KUDO ET AL.

It is certified that error appears in the above-identified patent and that said Letters Patent is hereby corrected as shown below:

COLUMN 29:

Line 8, "disposed" should read --disposed at a--.

Line 14, "of" should read --of the--.

COLUMN 30:

Line 1, "generate" should read --generating--.

Signed and Sealed this

Twenty-sixth Day of October, 1999

*Attest:*

Q. TODD DICKINSON

*Attesting Officer*

*Acting Commissioner of Patents and Trademarks*